US005395749A

United States Patent [19]

Negoro et al.

[11] Patent Number: 5,395,749

[45] Date of Patent: Mar. 7, 1995

[54] SILVER HALIDE COLOR PHOTOGRAPHIC LIGHT-SENSITIVE MATERIAL

[75] Inventors: Masayuki Negoro; Hiroo Takizawa; Masakazu Morigaki, all of Kanagawa, Japan

[73] Assignee: Fuji Photo Film Co., Ltd., Kanagawa, Japan

[21] Appl. No.: 151,170

[22] Filed: Nov. 12, 1993

[30] Foreign Application Priority Data

Nov. 13, 1992 [JP] Japan ..... 4-328663

[51] Int. Cl.[6] ..... G03C 1/34

[52] U.S. Cl. ..... 430/551; 430/556; 430/557

[58] Field of Search ..... 430/551, 556, 557, 607, 430/611

[56] References Cited

U.S. PATENT DOCUMENTS

| | | | |
|---|---|---|---|
| 4,088,491 | 5/1978 | Odenwalder et al. | 430/957 |
| 4,286,053 | 8/1981 | Ishikawa et al. | 430/389 |
| 4,482,629 | 11/1984 | Nakagawa et al. | 430/542 |
| 4,496,645 | 1/1985 | Janssens et al. | 430/239 |
| 4,540,658 | 9/1985 | Sasaki et al. | 430/551 |

FOREIGN PATENT DOCUMENTS

| | | |
|---|---|---|
| 509311A1 | 10/1992 | European Pat. Off. . |
| 510576A1 | 10/1992 | European Pat. Off. . |
| 54-48536 | 4/1979 | Japan . |
| 62-103642 | 5/1987 | Japan . |
| 244042 | 10/1987 | Japan . |
| 1-200255 | 8/1989 | Japan . |
| 1-209440 | 8/1989 | Japan . |
| 1-210945 | 8/1989 | Japan . |
| 296050 | 12/1991 | Japan . |

*Primary Examiner*—Lee C. Wright

*Attorney, Agent, or Firm*—Birch, Stewart, Kolasch & Birch

[57] ABSTRACT

A silver halide color photographic light-sensitive material comprising a support having thereon at least one layer which contains at least one compound represented by the following formula (I):

(I)

wherein $R^1$ and $R^2$ may be the same or different and each independently represents an alkyl group, an aryl group or a heterocyclic group; Ar represents an aryl group; Ar and $R^1$ may be linked to form a 5- to 7-membered ring but $R^2$ and Ar or $R^1$ do not link with each other; and n represents an integer of 0 to 2.

13 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material (hereinafter simply referred to as light-sensitive material).

BACKGROUND OF THE INVENTION

In general, light-sensitive materials have silver halide emulsion layers which are sensitive to the three primary colors, namely, red, green and blue. Color images are reproduced by a so-called subtractive color process wherein three kinds of color generating agents (couplers) in the emulsion layers generate colors which are complementary to the color sensed by each layer. Color images obtained by photographic processing of this light-sensitive material are generally composed of azomethine dyes or indoaniline dyes which are formed by a reaction between an oxidation product of an aromatic primary amine developing agent and a coupler. Color photographic images thus obtained are not necessarily stable with respect to light, or humidity and heat, and when they are exposed to light for a prolonged period of time or preserved under high temperatures and high humidities, color fading and discoloration of the color images occur, and the color images deteriorate.

Such fading and discoloration of color images are serious drawbacks for recording materials. In order to eliminate these drawbacks, development of couplers which are capable of providing dyes having excellent fastness, and countermeasures such as use of anti-fading agents and use of UV absorbers for preventing images from being deteriorated by ultraviolet rays, and so on have been proposed.

As for the anti-fading agents, there have been known, for example, hydroquinones, hindered phenols, catechols, gallic acid esters, aminophenols, hindered amines, chromanols, indans; ethers or esters wherein the phenolic hydroxyl groups of these compounds are silylated, acylated or alkylated; and metal complexes of these compounds.

Sulfides and sulfoxides of a certain structure, sulfur-containing heterocyclic compounds and tetrahydrothiopyran compounds of a certain structure are disclosed in U.S. Pat. Nos. 4,540,658, 4,880,733, and 4,704,350, British Patent No. 1,410,846, JP-A-54-48536 (the term "JP-A" as used herein means an "unexamined published Japanese patent application"), JP-A-63-43146, JP-A-63-149644, JP-A-62-103642, JP-A-2-208653, JP-A-1-113382, JP-A-1-200255, European Patent Application Nos. 178,794A, 310,551A, 310,552A and 509,311A1, and so on.

Although these compounds are effective for preventing fading or discoloration of color images, their properties fail to meet customers' demands for images of high quality, and excellent effects in color photographs have not yet obtained.

SUMMARY OF THE INVENTION

A first object of the present invention is to provide a light-sensitive material having significantly improved fastness to light of color images.

A second object of the present invention is to provide a light-sensitive material wherein the fastness is improved such that color generation properties, color hue and photographic characteristics are not adversely affected.

A third object of the present invention is to provide a light-sensitive material wherein color balance remains unchanged in the fading of the three colors of yellow, magenta and cyan.

A fourth object of the present invention is to provide a light-sensitive material in which there is minimal generation of color stains and yellow stains in the blank area caused by light and heat.

A fifth object of the present invention is to provide a light-sensitive material which has excellent spectral absorption characteristics, has excellent color reproduction and has significantly improved fastness of color images.

It has been found that these and other objects can be attained by a silver halide color photographic light-sensitive material comprising a support having thereon at least one layer which contains at least one compound represented by the following formula (I):

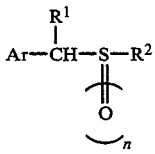

(I)

wherein $R^1$ and $R^2$ may be the same or different and each represents an alkyl group, an aryl group or a heterocyclic group; Ar represents an aryl group; Ar and $R^1$ may be linked to form a 5- to 7-membered ring but $R^2$ and Ar or $R^1$ do not link with each other; and n represents an integer of 0 to 2.

DETAILED DESCRIPTION OF THE INVENTION

The compounds represented by formula (I) according to the present invention are now described in detail.

The alkyl group represented by $R^1$ and $R^2$ in formula (I) may have a linear, branched or cyclic structure, and it may optionally be substituted. It has preferably 1 to 36 carbon atoms, and may be, for example, methyl, n-propyl, sec-butyl, n-dodecyl, tert-octyl, n-octadodecyl, benzyl, cyclopropyl and cyclohexyl. The aryl group represented by $R^1$, $R^2$ or Ar may optionally be substituted, and has preferably 6 to 46 carbon atoms. Examples of the aryl group include phenyl, p-hexadecyloxyphenyl, 2,5-di-tert-amylphenyl, naphthyl and the like. The heterocyclic group of $R^1$ and $R^2$ may optionally be substituted, and preferably has 0 to 46 carbon atoms. The heterocyclic group may be a saturated heterocyclic group or an unsaturated heterocyclic group (including heteroaromatic groups). It is preferably a 4- to 8-membered ring having a hetero atom of O, S, N or P. Examples of the heterocyclic group include 2-furyl, 2-thienyl, 2-pyrimidinyl and 2-benzothiazolyl. Of these, hetero aromatic ring groups are preferred. The substituents which may be contained in the above-mentioned alkyl, aryl and heterocyclic groups include those which will be listed as examples of $R^{21}$ hereinafter. Here, Ar and $R^1$ may be linked to form a 5- to 7-membered ring, but $R^2$ and Ar or $R^1$ do not link with each other. n is preferably 0 or 2, and it is especially preferable that n is 0.

Throughout the specification, the restrictions as to the number of carbon atoms refer to the total number of carbon atoms inclusive of the carbon atoms in the substituents in cases in which substituents exist.

The compounds represented by formula (I) include compounds of formulae (I-A), (I-B) and (I-C).

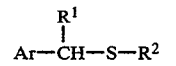

(I-A)

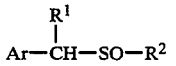

(I-B)

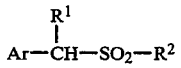

(I-C)

wherein $R^1$, $R^2$ and Ar are each as defined in formula (I). Here, $R^1$ and Ar may be linked to form a 5- to 7-membered ring.

In the compounds represented by formulae (I), (I-A), (I-B) and (I-C), $R^2$ is preferably an alkyl group or an aryl group, more preferably an alkyl group, still more preferably an alkyl group having a substituent, and most preferably a benzyl group which may optionally have a substituent. $R^1$ is preferably an alkyl group or an aryl group.

Of the compounds represented by formulae (I-A), (I-B) and (I-C), the following compounds represented by formulae (I-A-a), (I-B-b) and (I-C-c) are especially preferred, respectively.

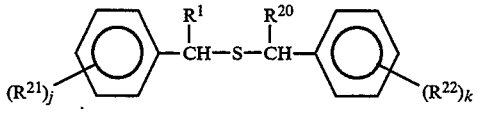

(I-A-a)

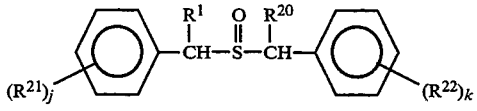

(I-B-b)

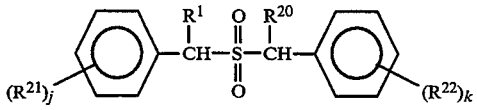

(I-C-c)

wherein $R^1$ has the same meaning as $R^1$ of formula (I); $R^{20}$ represents a hydrogen atom or a group as defined by $R^1$; $R^1$ and $R^{20}$ may be the same or different from each other; $R^{21}$ and $R^{22}$ represent substituents which may be the same or different from each other; $R^1$ and $R^{21}$, or $R^{20}$ and $R^{22}$ may be linked with each other to form a 5- to 7-membered ring, but $R^1$ and $R^{20}$ or $R^{22}$, and $R^{20}$ and $R^{21}$ cannot be linked with each other; j and k each represents an integer of 0 to 5; and when both j and k are not less than 2, plural each $R^{21}$ and plural each $R^{22}$ may be the same or different; among plural $R^{21}$, any two $R^{21}$ in the ortho relation may be linked to form a 5- to 7-membered ring; and among plural $R^{22}$, those $R^{22}$ in the ortho-relation may be linked to form a 5-to 7-membered ring.

Examples of the substituents of $R^{21}$ and $R^{22}$ include an alkyl group (for example, methyl, n-propyl, sec-butyl, n-dodecyl, n-octadodecyl, benzyl, cyclopropyl and cyclohexyl), an alkenyl group (for example, vinyl, allyl, cyclohexenyl, 2-pentenyl and octadecenyl), an alkynyl group (for example, ethynyl, 2-propenyl, 2-penten-4-ynyl and hexadecynyl), an aryl group (for example, phenyl, p-hexadecyloxyphenyl, 2,5-di-tert-amylphenyl and naphthyl), a heterocyclic group (for example, 2-furyl, 2-thienyl, 2-pyrimidinyl and 2-benzothiazolyl), a halogen atom (for example, chlorine and bromine), a cyano group, a nitro group, a hydroxyl group, an alkoxy group (for example, methoxy, ethoxy, 2-methoxyethoxy, 2-dodecylethoxy and 2-methanesulfonylethoxy), an aryloxy group (for example, phenoxy, 2-methylphenoxy, 4-tert-butylphenoxy, 3-nitrophenoxy and 3-tert-butyloxycarbamoylphenoxy), an alkylthio group (for example, methylthio, octylthio, tetradecylthio, 2-phenoxyethylthio, 3-phenoxypropylthio and 3-(4-tert-butylphenoxy)propylthio), an arylthio group (for example, phenylthio, 2-butoxy-5-tert-octylphenylthio, 3-pentadecylphenylthio, 2-carboxyphenylthio and 4-tetradecaneamidophenylthio), an acyloxy group (for example, acetoxy), a sulfonyloxy group (for example, methanesulfonyloxy and benzenesulfonyloxy), an amino group, an alkylamino group (for example, methylamino, butylamino, dodecylamino, diethylamino and methylbutylamino), an arylamino group (for example, phenylamino, N-methyl-N-phenylamino), an acylamino group (for example, acetylamino, propanoylamino, sec-butanoylamino, n-dodecanoylamino), a sulfonamide group (for example, methanesulfonamide, hexadecanesulfonamide, benzenesulfonamide, p-toluenesulfonamide, octadecanesulfonamide and 2-methoxy-5-tert-butylbenzenesulfonamide), an alkoxycarbonylamino group (for example, methoxycarbonylamino), an alkoxysulfonylamino group (for example, ethoxysulfonylamino), a ureido group (for example, phenylureido, methylureido, N,N-dibutylureido), an acyl group (for example, acetyl, benzoyl, pivaloyl, cyclopropionyl, alpha-(2,4-di-tert-amylphenoxy)butylyl, myristoyl, stearoyl, naphthoyl, m-pentadecylbenzoyl and isonicotinoyl), an alkoxycarbonyl group (for example, methoxycarbonyl and dodecyloxycarbonyl), a carbamoyl group (for example, N-ethylcarbamoyl, N-benzylcarbamoyl, N,N-dibutylcarbamoyl, N-phenylcarbamoyl and N-hexadecylcarbamoyl), a sulfonyl group (for example, methanesulfonyl, octanesulfonyl, benzenesulfonyl and toluene sulfonyl), a sulfinyl group (for example, dodecanesulfinyl, 3-pentadecylphenylsulfinyl and 3-phenoxypropylsulfinyl), an alkoxysulfonyl group (for example, methoxysulfonyl), and a sulfamoyl group (for example, N-ethylsulfamoyl, N,N-dipropylsulfamoyl, N-(2-dodecyloxyethyl)sulfamoyl, N-ethyl-N-dodecylsulfamoyl and N,N-diethylsulfamoyl).

In the specification of the present invention, each group may be substituted, in cases in which substitution is possible, by the above substituents, unless otherwise indicated.

Of the groups represented by $R^{20}$, preferable ones are those listed as $R^1$. It is preferable that $R^{20}$ and $R^1$ are the same. Of the groups represented by $R^{21}$ and $R^{22}$, preferable ones are an alkyl group, an aryl group, a heterocyclic group, an alkoxy group, an aryloxy group, an alkylthio group, an arylthio group, an alkoxycarbonyl group, a carbamoyl group, an acyl group or a halogen atom, and more preferably, an alkyl group, an aryl group, an alkoxy group, an aryloxy group, an alkylthio group, an arylthio group and a halogen atom.

It is preferable that j and k are respectively 1 through 5, more preferable that j and k are 1 or 2, and most preferable that j and k are 1.

Specific examples of the compounds of formula (I) will now be given below, which however, should not be construed as limiting the present invention thereto.
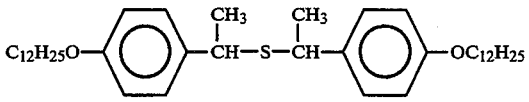
(I-A-1)
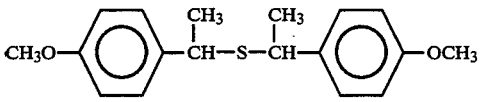
(I-A-2)
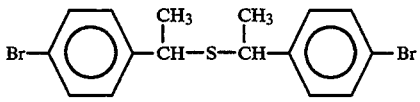
(I-A-3)
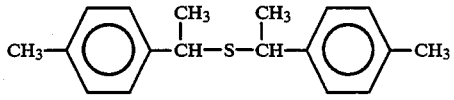
(I-A-4)
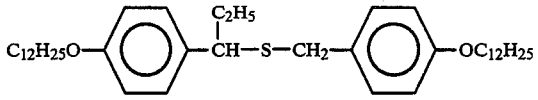
(I-A-5)
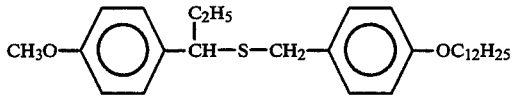
(I-A-6)
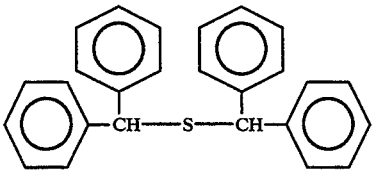
(I-A-7)
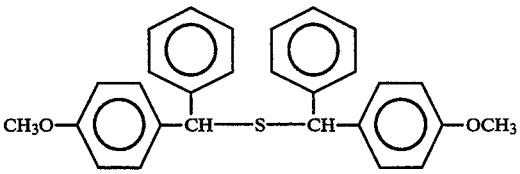
(I-A-8)
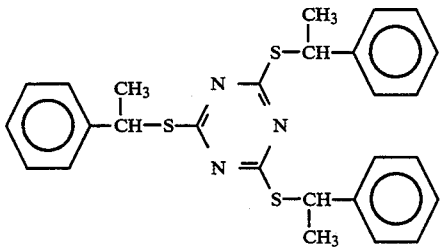
(I-A-9)
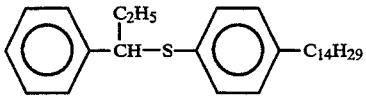
(I-A-10)

-continued
(I-A-11)
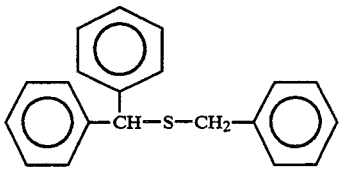
(I-A-12)
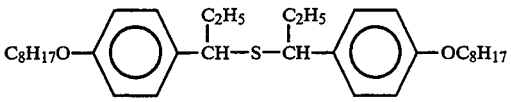
(I-A-13)
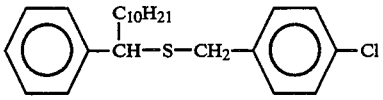
(I-A-14)
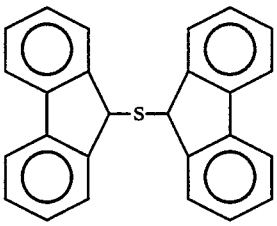
(I-A-15)
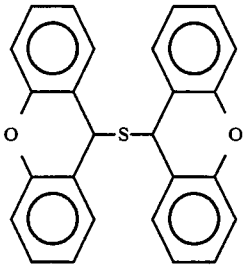
(I-A-16)
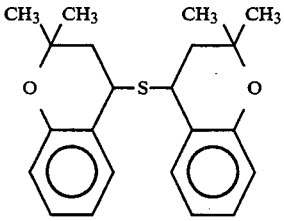
(I-A-17)
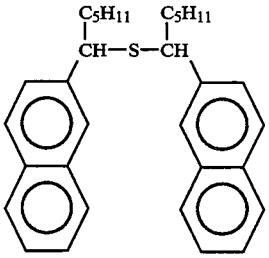
(I-A-18)
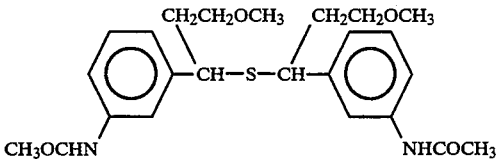

-continued
(I-A-19)
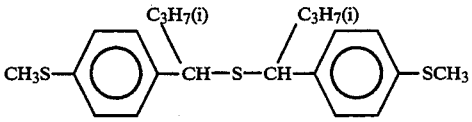
(I-A-20)
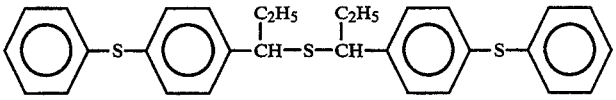
(I-B-1)
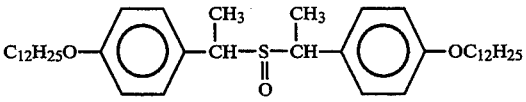
(I-B-2)
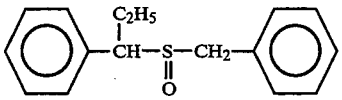
(I-B-3)
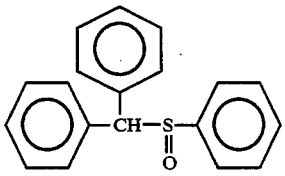
(I-B-4)
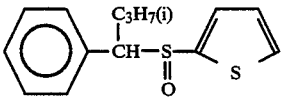
(I-B-5)
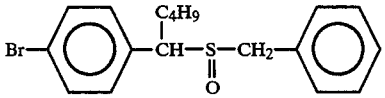
(I-B-6)
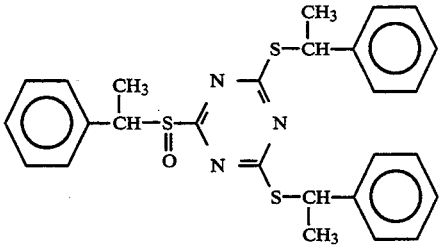
(I-B-7)
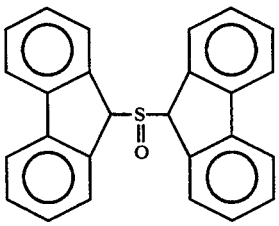

-continued
(I-B-8)
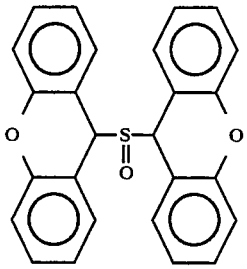
(I-B-9)
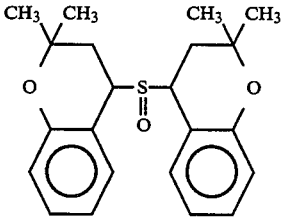
(I-B-10 )
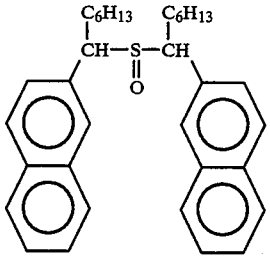
(I-B-11)
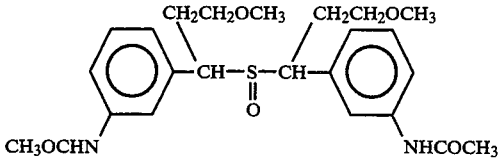
(I-B-12)
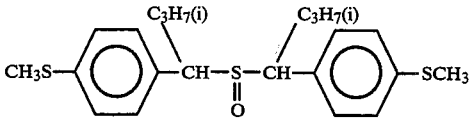
(I-B-13)
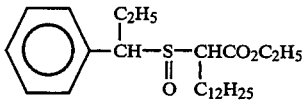
(I-C-1)
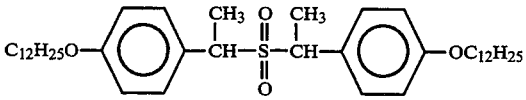
(I-C-2)
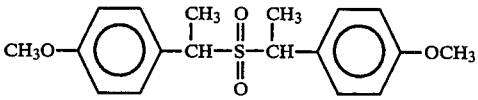
(I-C-3)
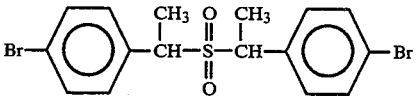
(I-C-4)
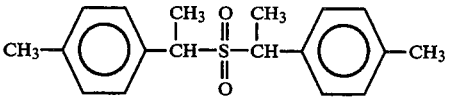

-continued
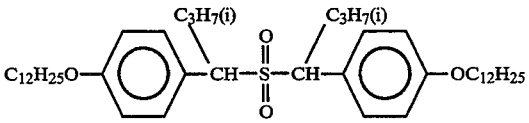
(I-C-5)
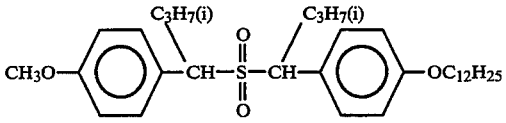
(I-C-6)
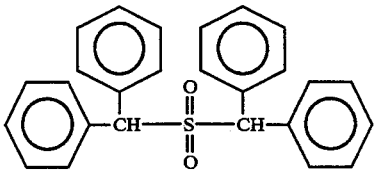
(I-C-7)
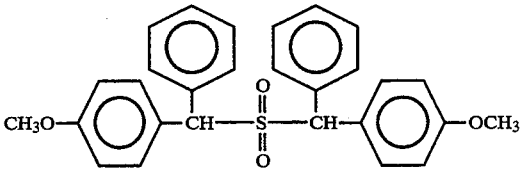
(I-C-8)
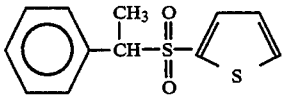
(I-C-9)
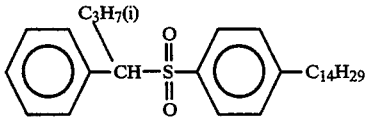
(I-C-10)
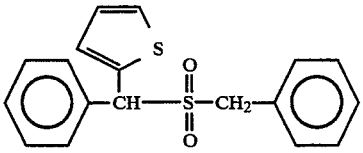
(I-C-11)
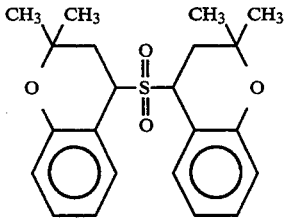
(I-C-12)
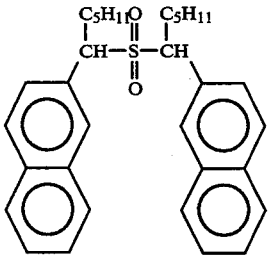
(I-C-13)

-continued

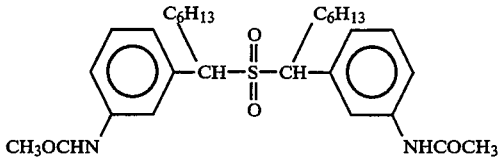
(I-C-14)

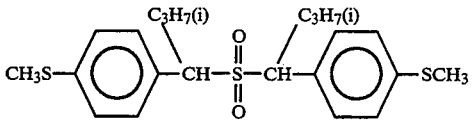
(I-C-15)

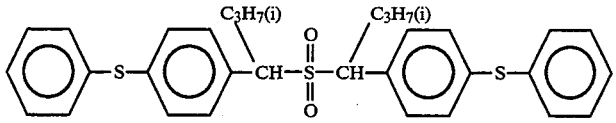
(I-C-16)

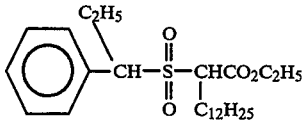
(I-C-17)

A synthesis example of a representative compound is described below.

Synthesis Example of Compound (I-A-5)

9.2 g of 4-dodecyloxybenzylthiol was added dropwise to a mixture of 50 ml of tetrahydrofuran and 1.54 g of sodium hydride while the mixture was cooled on ice, and the mixture was stirred for 30 minutes. Thereafter, 9.3 g of 4-dodecyloxybenzylchloride was added dropwise thereto. After stirring for 5 hours, the reaction solution was poured into water, and extracted with 150 ml of ethyl acetate, followed by washing with 50 ml of an aqueous sodium chloride solution and drying with anhydrous magnesium sulfate. After the anhydrous magnesium sulfate was removed by filtration, ethyl acetate was evaporated under reduced pressure to obtain crystals. The obtained crude crystals were purified by column chromatography, whereby 8.0 g of the target compound was obtained as colorless crystals (yield: 92%). The obtained crystals were confirmed to be the compound (I-A-5) of the example of the present invention by mass spectrum, NMR spectrum, and infrared absorption spectrum data.

The light-sensitive materials according to the present invention comprise a support having thereon at least one layer which contains at least one compound represented by formula (I).

It is preferred that the compounds represented by formula (I) are employed in amounts of 0.0002 to 20 g, more preferably, 0.001 to 5 g per 1 $m^2$ of the light-sensitive material.

It is preferable that the compounds represented by formula (I) of the present invention are used in combination, in the same layer of the coupler, with a cyan coupler, a magenta coupler and a yellow coupler, which generate colors of cyan, magenta and yellow, respectively, when coupled with an oxidation product of an aromatic primary amine color developing agent.

The couplers which are used in combination with the above-described compounds may be 4-equivalent or 2-equivalent with respect to the silver ion, and may be in the form of a polymer or an oligomer. Furthermore, the couplers which are used in combination with the above-described compounds may be used alone or a mixture of two or more kinds thereof may be used.

The compounds represented by formula (I) according to the present invention can be used in combination with any couplers. However, in view of the effects of the invention, a yellow coupler and a cyan coupler are preferable, and a yellow coupler is particularly preferable. When the compounds are used in combination with cyan couplers, pyrolotriazole type couplers are preferable. When the compounds are used in combination with magenta couplers, pyrazoloazole type couplers are preferable, and pyrazolotriazole type couplers are particularly preferable. In a case in which the compounds are used in combination with magenta couplers, it is more preferable that known anti-fading agents are also used. Examples of anti-fading agents include diethers of hydroquinone derivatives, diethers of resorcinol derivatives, diethers of catechol derivatives, tetraalkoxyspiroindan derivatives, aniline derivatives and ethers of aminophenol derivatives. When pyrazolotriazole type magenta couplers are used, use of compounds represented by formula (I) of the present invention together with diethers of hydroquinone derivatives, p-alkoxyaniline derivatives or tetraalkoxyspiroindan derivatives is effective in improving fastness to light in low color density regions.

When the compounds represented by formula (I) according to the present invention are used in the same layer as couplers, the proportion between the present compounds and the couplers may vary depending on the couplers to be used, but it is preferable that the present compounds are used in amounts of 0.5 to 1000 mol %, more preferably 1 to 500 mol %, still more preferably 5 to 200 mol %, based on the amounts of couplers used in the same layer.

The compounds according to the present invention may be used together with known anti-fading agents. Such a combination will provide enhanced anti-fading effects. Furthermore, two or more compounds represented by formula (I) may be used together.

Couplers suitable for use in the present invention will be set forth below.

Specific examples of yellow couplers which may be used in the present invention are described in U.S. Pat. Nos. 3,933,501, 4,022,620, 4,326,024, 4,401,752, 4,248,961, JP-B-58-10739 (the term "JP-B" as used herein means an "examined Japanese patent publication"), British Patent Nos. 1,425,020, 1,476,760, U.S. Pat. Nos. 3,973,968, 4,314,023, 4,511,649, 5,118,599, European Patent Application Nos. 249,473A, 446,863A, 447,969, JP-A-63-23145, JP-A-63-123047, JP-A-1-250944, JP-A-1-213648, JP-A-2-139544, JP-A-3-179042 and JP-A-3-203545.

Yellow couplers which are preferably used in the present invention are represented by formula (Y):

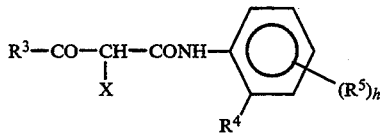

(Y)

wherein $R^3$ represents a tert-alkyl group, an aryl group or a group $—N(R^6)(R^7)$, $R^4$ represents a hydrogen atom, a halogen atom, an alkoxy group, an aryloxy group, an alkyl group or a dialkylamino group; $R^5$ represents a substituent; X represents a hydrogen atom or a group which is releasable in a coupling reaction with an oxidation product of an aromatic primary amine color developing agent (hereinafter referred to as a releasable group); h represents an integer of 0 to 4; when h is not less than 2, each $R^5$ may be the same or different; $R^6$ and $R^7$ may be the same or different from each other, and each independently represents an alkyl group, an alkenyl group, an aryl group or a heterocyclic group; and $R^6$ and $R^7$ may be linked to form a 5- to 6-membered ring which may optionally have a substituent, and may form a condensed ring with an aromatic ring, an aliphatic ring or a heterocyclic ring.

Specific examples of $R^5$ include a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, a sulfonyl group, a sulfonylsulfamoyl group, a sulfonylcarbamoyl group, a ureido group, an acylcarbamoylamino group, an acylsulfamoylamino group, a sulfamoylamino group, an alkoxycarbonylamino group, an acylsulfamoyl group, an acylcarbamoyl group, a nitro group, a heterocyclic group, a cyano group, an acyl group, an acyloxy group, an alkylsulfonyloxy group or an arylsulfonyloxy group; and the releasable group as defined for X represents a heterocyclic group which is bound to the coupling active site with a nitrogen atom, an aryloxy group, an arylthio group, an acyloxy group, an alkylsulfonyloxy group, a heterocyclicoxy group or a halogen atom.

In formula (Y), $R^3$ is preferably a tert-butyl group, a dioxane group whose 1-position is substituted by an alkyl group, a cyclopropyl group whose 1-position is substituted by an alkyl group, an unsubstituted phenyl group or a phenyl group substituted by a halogen atom, an alkyl group or an alkoxy group, a dialkylamino group, an alkylarylamino group and an indolinyl group; $R^4$ represents a halogen atom, a trifluoromethyl group, an alkoxy group or an aryloxy group; $R^5$ represents a halogen atom, an alkoxy group, an alkoxycarbonyl group, a carbonamide group, a sulfonamide group, a carbamoyl group or a sulfamoyl group; X represents an aryloxy group or a heterocyclic group containing a 5- to 7-membered ring which is bound to the coupling active site with a nitrogen atom, and optionally containing N, S, O and P; and h is an integer of 0 to 2.

Of these, it is especially preferable that $R^3$ is a 1-alkylcyclopropyl group, a dialkylamino group, an alkylarylamino group or an indolinyl group.

The couplers represented by formula (Y) are such that the substituents $R^3$, X, $R^4$ or $R^5$ may form a dimer a higher polymer or a polymer coupler, which contains a mother nucleus, or a main chain of a homopolymer or a copolymer containing a non-color generation monomer unit.

Specific examples of couplers represented by formula (Y) are shown below.

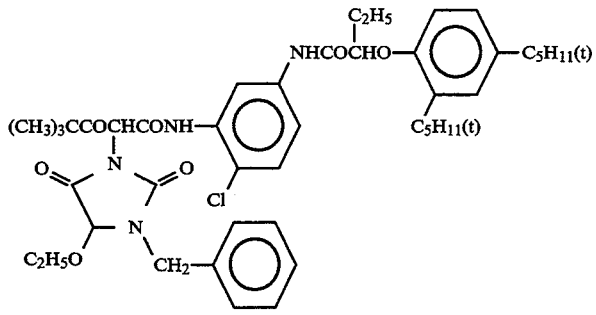

(Y-1)

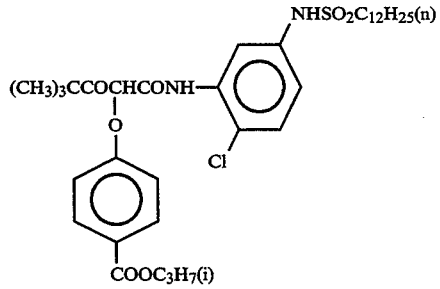

(Y-2)

-continued
(Y-3)
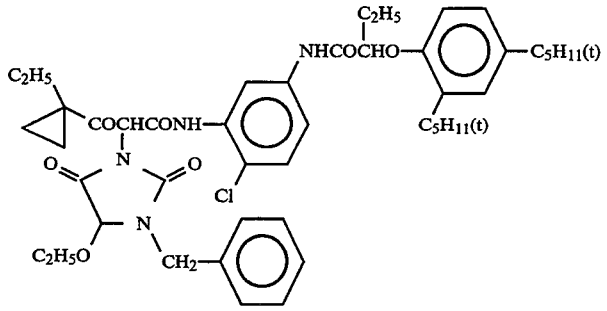
(Y-4)
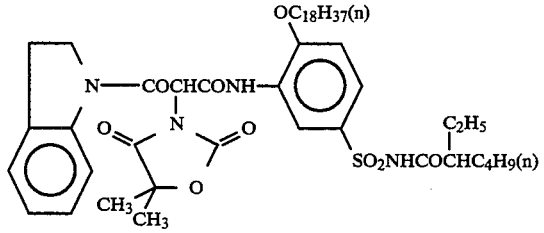
(Y-5)
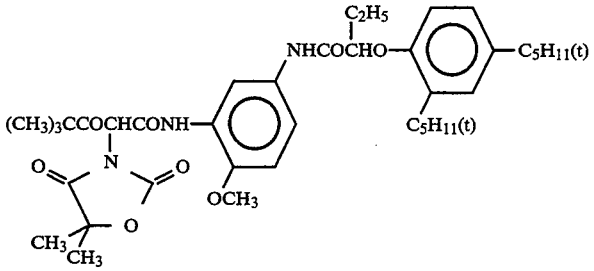
(Y-6)
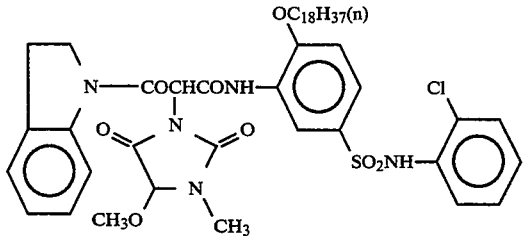
(Y-7)
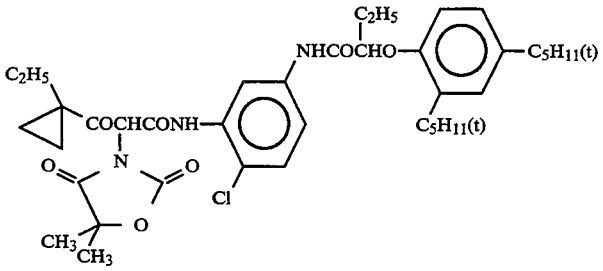
(Y-8)
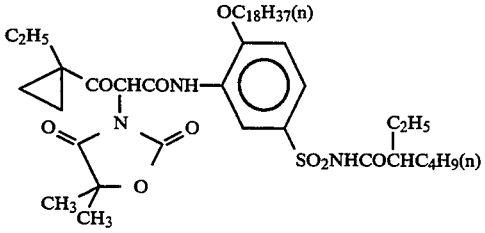

-continued
(Y-9)
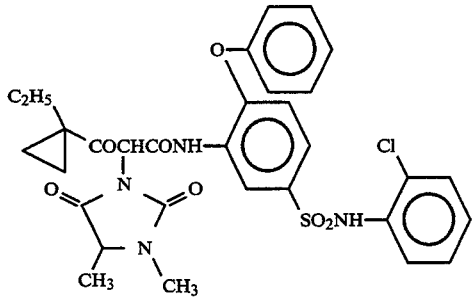
(Y-10)
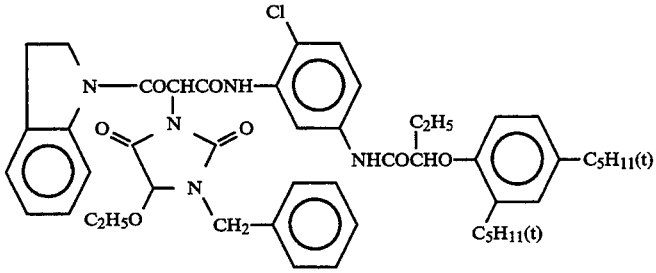
(Y-11)
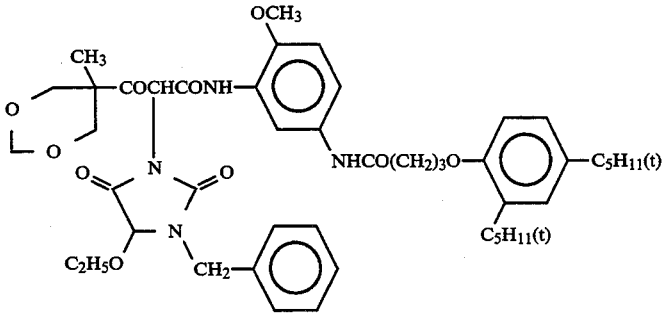
(Y-12)
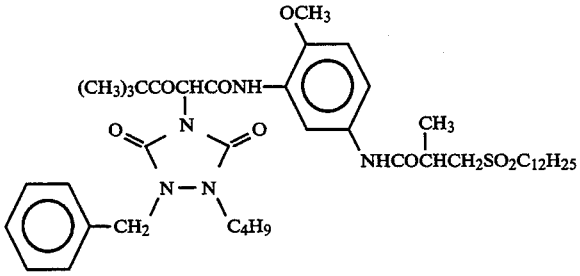
(Y-13)
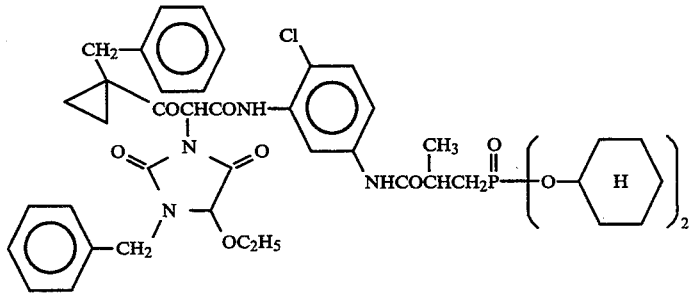

-continued (Y-14)

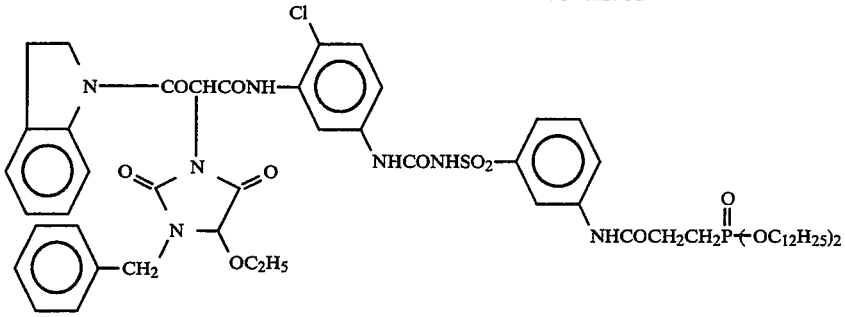

Yellow couplers which may be used in the present invention, other than the above-mentioned compounds, and/or synthesis methods thereof are described, for example, in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837 and 4,729,944, European Patent Application Nos. 30,747A, 284,081A, 296,793A, 313,308A, and 447,964, West German Patent No. 3,107,173C, JP-A-58-42044, JP-A-59-174839, JP-A-62-276547, JP-A-63-123047, Japanese Patent Application Nos. 3-179042 and 3-203545.

Cyan couplers include phenol type and naphthol type couplers. Preferred examples thereof are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (OLS) 3,329,729, European Patent Application Nos. 121,365A, 249,453A and 333,185A2, U.S. Pat. Nos. 3,446,622, 4,333,999, 4,775,616, 4,451,559, 4,427,767, 4,690,889, 4,254,212 and 4,296,199 and JP-A-61-42658. Furthermore, azole type couplers described in JP-A-64-553, JP-A-64-554, JP-A-64-555, JP-A-64-556, European Patent Application Nos. 456,226A1, 484,909A1, 488,248A1 and 491,197A1, imidazole type couplers described in U.S. Pat. No. 4,818,672 and JP-A-2-33144 and cyclic active methylene type cyan couplers described in JP-A-64-32260 can also be used.

Examples of preferable cyan couplers include pyrolotriazole type cyan couplers described in European Patent Application Nos. 488,248A1 and 491,197A1 and couplers of formulae (C-I) and (C-II) described in JP-A-2-189544, page 17, left lower column to page 20, left lower column. Especially preferred cyan couplers are pyroloazole type cyan couplers represented by the following formulae (CA) or (CB).

(CA)

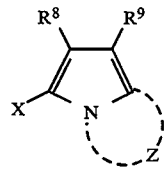

(CB)

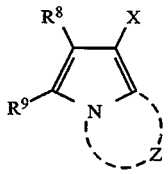

wherein Z represents a non-metallic atomic group necessary for forming an azole ring whose hetero atom is nitrogen; $R^8$ and $R^9$ each represents an electron-withdrawing group having a Hammett's substituent constant $\sigma_p$ of not less than 0.20; the sum of the $\sigma_p$ values of $R^8$ and $R^9$ is not less than 0.65; and X represents a hydrogen atom or a releasable group in a coupling reaction with an oxidation product of an aromatic primary amine color developing agent.

The cyan couplers used in the present invention are such that both $R^8$ and $R^9$ are electron-withdrawing groups having $\sigma_p$ values of not less than 0.20, and the sum of the $\sigma_p$ values of $R^8$ and $R^9$ is not less than 0.65, whereby colors are generated as cyan images.

$R^8$ and $R^9$ are preferably electron-withdrawing groups having $\sigma_p$ values of not less than 0.30, with the upper limit being 1.0.

The sum of the $\sigma_p$ values of $R^8$ and $R^9$ is preferably a value of not less than 0.70, with the upper limit being about 1.8.

Specific examples of $R^8$ and $R^9$ which are electron-withdrawing groups having $\sigma_p$ values of not less than 0.20 include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by other electron-withdrawing groups having $\sigma_p$ values of not less than 0.20, a heterocyclic group, a halogen atom, an azo group or a serenocyanate group.

Preferable examples of $R^8$ and $R^9$ are an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by two or more electron-withdrawing groups having $\sigma_p$ values of not less than 0.20 and a heterocyclic group. Of these, an aryloxycarbonyl group, an alkoxycarbonyl group, a nitro group, a cyano group, an arylsulfonyl group, a carbamoyl group and a halogenated alkyl group are particularly preferred.

A cyano group is the most preferable group for $R^8$. An alkoxycarbonyl group and an aryloxycarbonyl group are particularly preferable groups for $R^9$, and a branched alkoxycarbonyl group being most preferred.

The Hammett's substituent constant $\sigma_p$ is described, for example, in "Lange's Handbook of Chemistry" (edited by J. A. Dean, 12th ed., 1979, McGraw-Hill) or "Kagaku no Ryoiki" (special issue No. 122, pp. 96–103, 1979, Nankodo). Although pyrolotriazole type cyan couplers are not benzene derivatives, $\sigma_p$ is used, irrespective of the position of substitution, as an indicator which indicates the electron effect of the substituent.

X has the same meaning as in formula (Y).

Preferable examples of X include a halogen atom, an alkoxy group, an aryloxy group, an alkyl or arylthio group, and a 5-membered or 6-membered nitrogen-containing heterocyclic group which is bound to the coupling active site with a nitrogen atom. Of these, a halogen atom or an arylthio group are more preferable, with a halogen atom being particularly preferable.

Z represents a non-metallic atomic group necessary for forming an azole group whose hetero atom is nitrogen. Examples of the azole ring include pyrazole ring, triazole ring, imidazole ring and tetrazole ring. Carbon atoms of these azole rings may optionally be substituted.

Among the cyan couplers represented by formulae (CA) and (CB), especially preferred are those represented by formula (CA). Among these, cyan couplers represented by formulae (C-A-1) or (C-A-2) are more preferable, and couplers represented by formula (C-A-1) are particularly preferred.

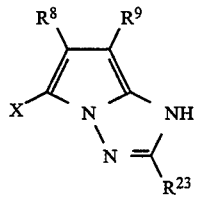

(C-A-1)

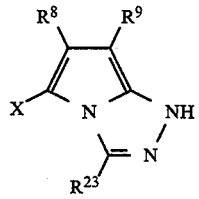

(C-A-2)

wherein X, $R^8$ and $R^9$ respectively have the same meanings as given hereinbefore.

Examples of the substituent $R^{23}$ include those listed for $R^{21}$ in formula (I-A-a), with an alkyl group and an aryl group being preferred. In view of the aggregation, an alkyl group or an aryl group having at least one substituent are more preferred, and still more preferred are an alkyl group or an aryl group which has at least one alkoxy group, sulfonyl group, sulfamoyl group, carbamoyl group, acylamide group or sulfonamide group as a substituent. Particularly preferred are an alkyl group or an aryl group having at least one alkoxy group, acylamide group or sulfonamide group as a substituent. When the aryl group has these substituents, it is preferred that the substitution takes place at the ortho-position.

Specific examples of the couplers represented by the formulae (CA) or (CB) are described below.

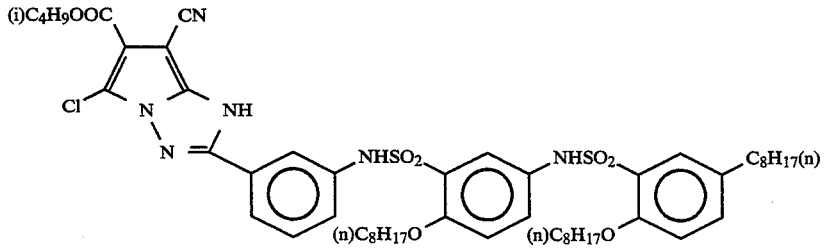

(C-1)

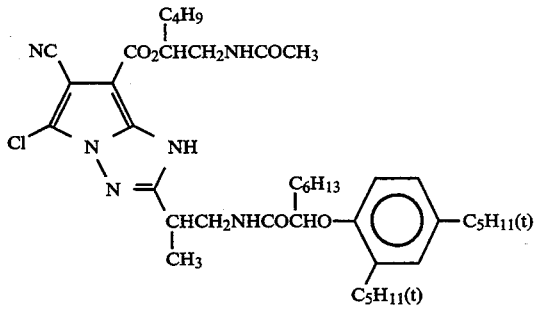

(C-2)

-continued
(C-3)
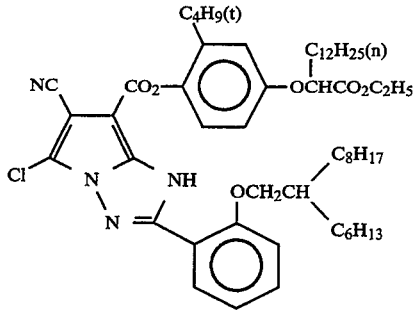
(C-4)
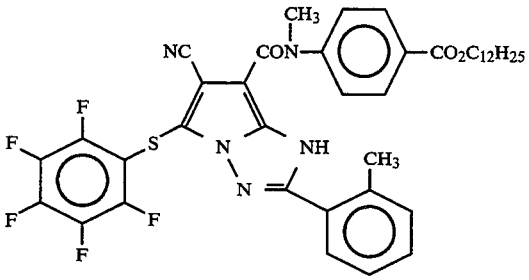
(C-5)
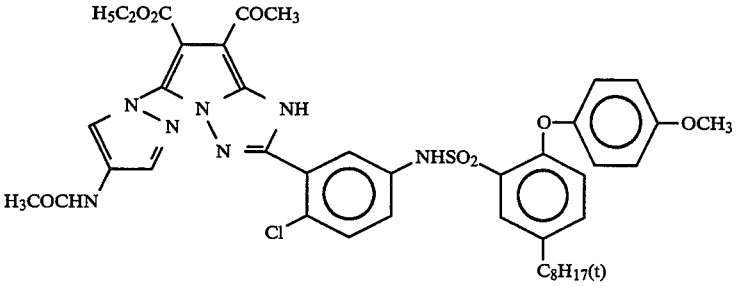
(C-6)
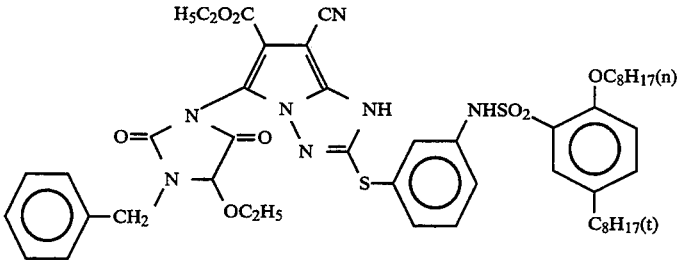
(C-7)
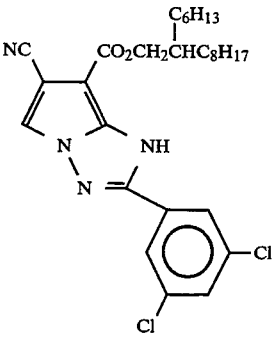

-continued
(C-8)
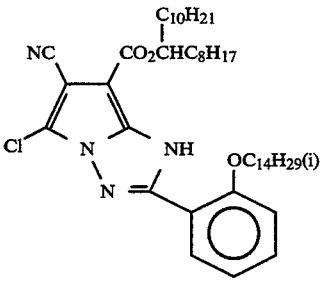
(C-9)
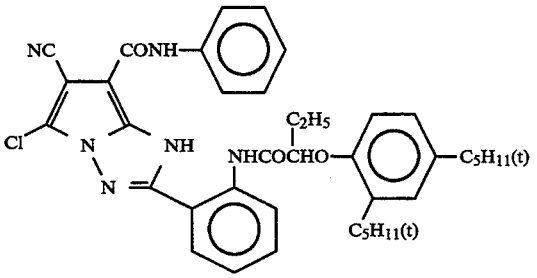
(C-10)
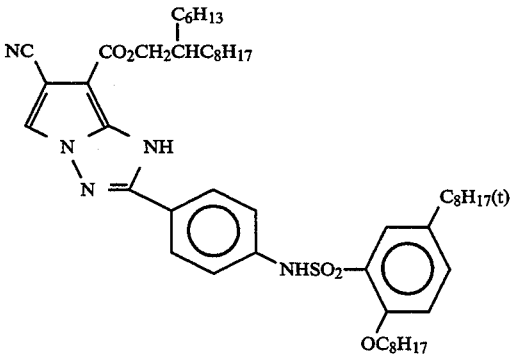
(C-11)
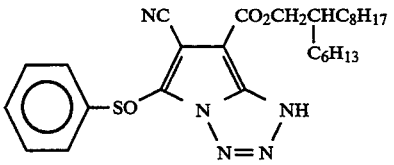
(C-12)
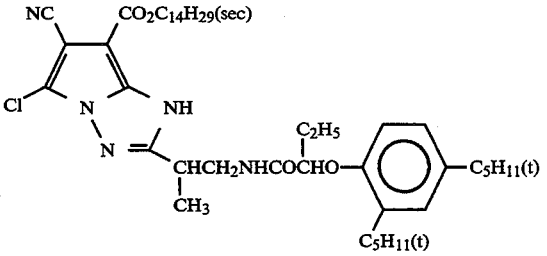

-continued
(C-13)
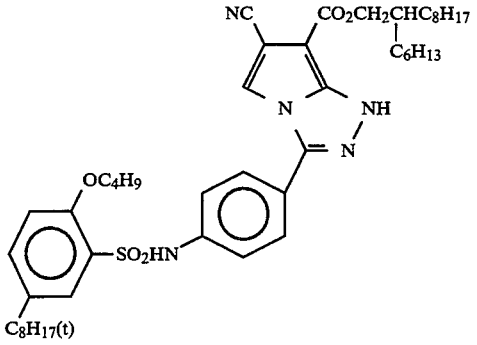
(C-14)
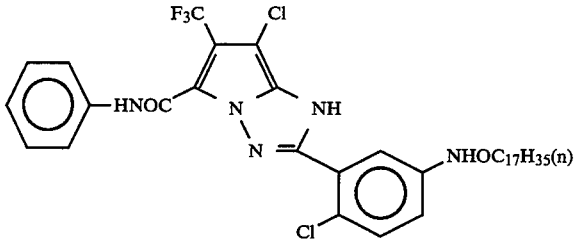
(C-15)
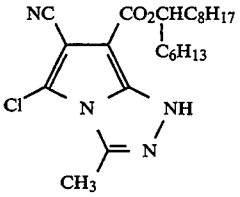
(C-16)
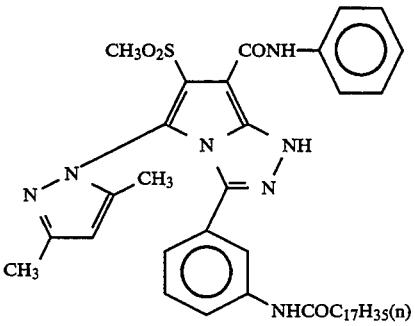
(C-17)
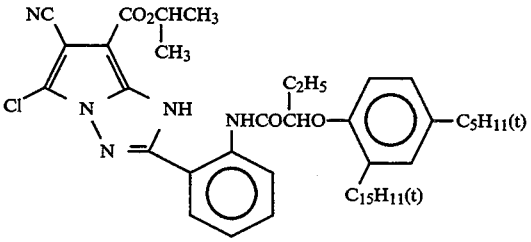
(C-18)
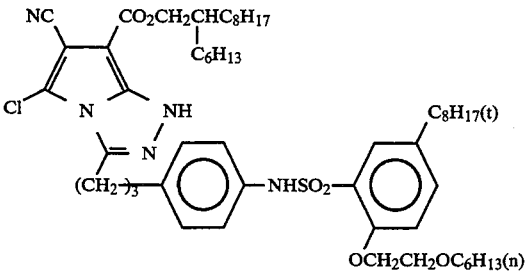

-continued (C-19)

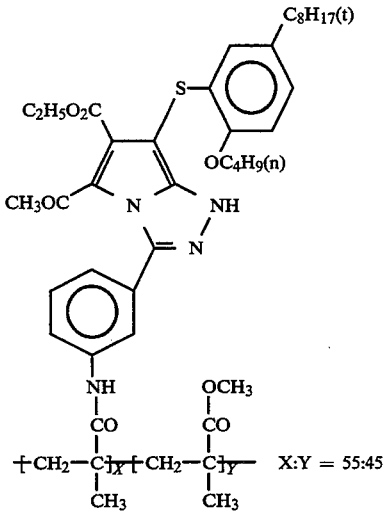

(C-20)

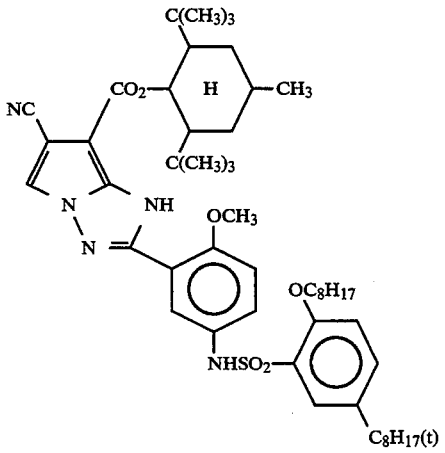

(C-21)

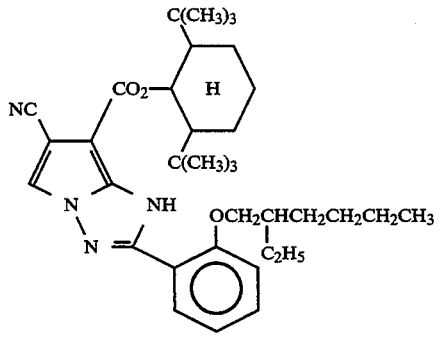

Examples of magenta couplers include 5-pyrazolone type and pyrazoloazole type compounds, and examples thereof are described, for example, in U.S. Pat. Nos. 4,310,619 and 4,351,897, European Patent No. 73,636, U.S. Pat. Nos. 3,061,432 and 3,725,067, Research Disclosure, No. 24220 (June, 1984), JP-A-33552, Research Disclosure, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. WO88/04795.

Preferable magenta couplers include pyrazoloazole type couplers of formula (I) described in JP-A-2-139544, page 3, right lower column to page 10, right lower column and 5-pyrazolone type couplers of formula (M-1) described in-JP-A-2-139544, page 17, left lower column to page 21, left upper column.

In the present invention, fastness to light is significantly improved in low color density regions. To assure this effect, it is preferred that the compounds represented by formula (I) of the present invention are used in a layer which contains a pyrazoloazole type magenta coupler and a compound of formulae (A) or (B).

Preferable pyrazoloazole type magenta couplers are those represented by formula (M) below.

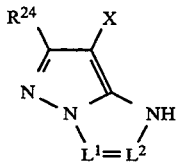

(M)

wherein X represents a hydrogen atom or a releasable group in a coupling reaction with an oxidation product of an aromatic primary amine color developing agent; $R^{24}$ represents a substituent; $L^1$ and $L^2$ each independently represents —C($R^{25}$)= or —N=, provided that either one of $L^1$ and $L^2$ is —N= and the other is —C($R^{25}$)=; and $R^{25}$ represents a hydrogen atom or a substituent.

The substituents represented by $R^{24}$ and $R^{25}$ include the groups listed for $R^{21}$ of formula (I-A-a).

Specific examples of couplers represented by formula (M) are described below.

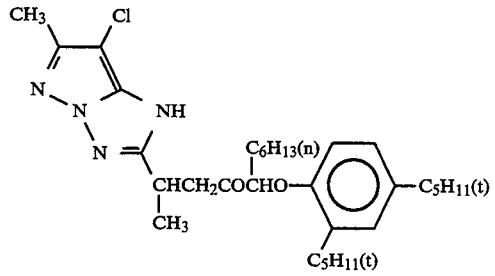

(M-1)

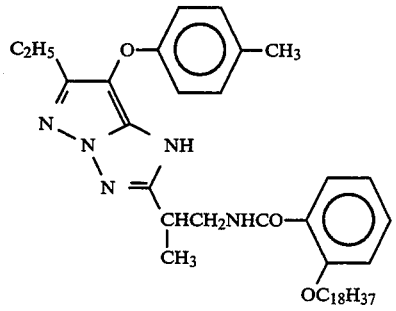

(M-2)

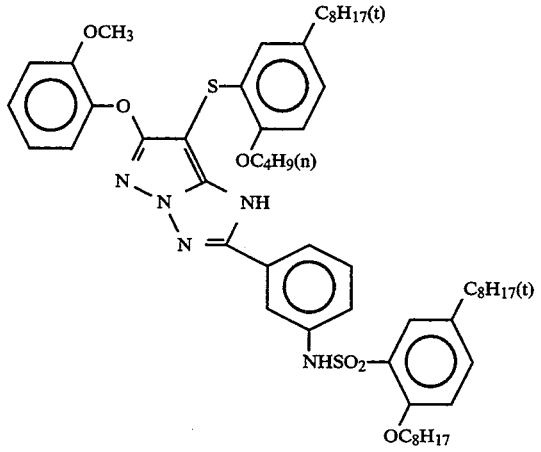

(M-3)

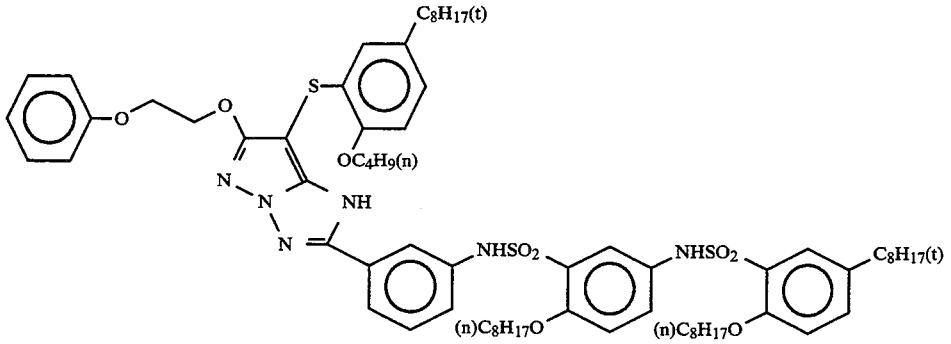

(M-4)

-continued
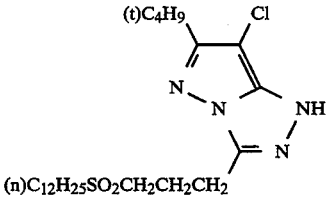
(M-5)
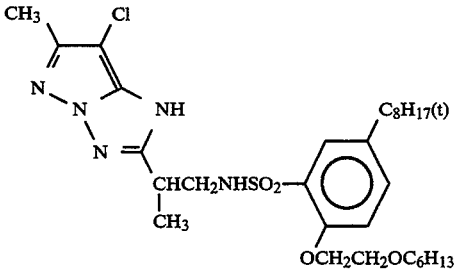
(M-6)
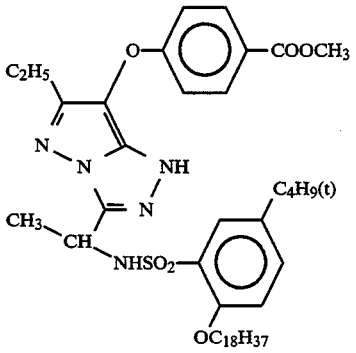
(M-7)
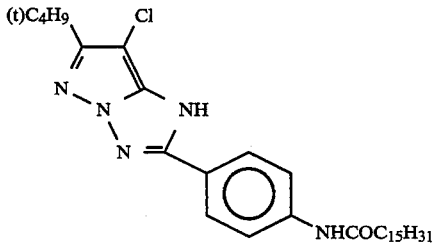
(M-8)
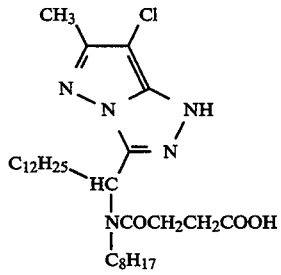
(M-9)
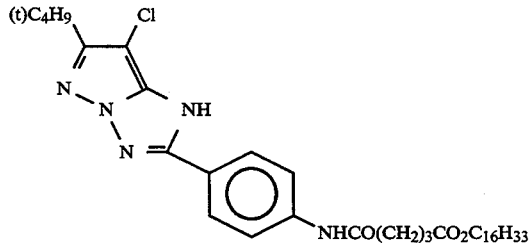
(M-10)
The compounds represented by formulae (A) or (B) are now explained.

(A)

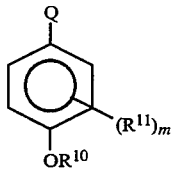

(B)

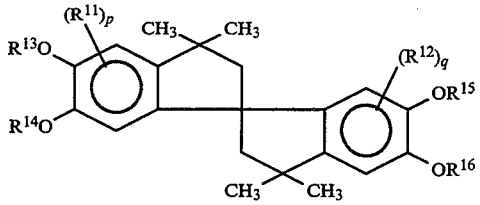

wherein Q represents —O—$R^{17}$ or —N($R^{18}$)($R^{19}$); $R^{10}$ and $R^{13}$ through $R^{19}$ each independently represents an alkyl group, and $R^{18}$ and $R^{19}$ may be linked to form a 5- to 6-membered ring; $R^{11}$ and $R^{12}$ each independently represents a substituent; m represents an integer of 0 to 4; when m is not less than 2, $R^{11}$ each may be the same or different; p and q each independently represents an integer of 0 to 2; when p and q are equal to 2, each $R^{11}$ and each $R^{12}$ may be the same or different; and the groups positioned in the ortho-relation with each other among $R^{11}$ or a plurality of $R^{11}$, Q and $OR^{10}$ may be linked to form a 5- to 6-membered ring.

The substituents for $R^{11}$ and $R^{12}$ include the groups listed for $R^{21}$ of formula (I-A-a). Preferable substituents include an alkyl group, an alkoxy group, an aryl group and a halogen atom.

Specific examples of the compounds represented by formulae (A) or (B) are described below.

(A-1)

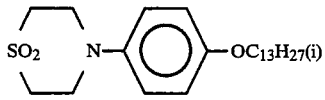

(A-2)

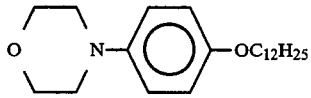

(A-3)

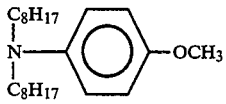

(A-4)

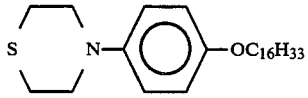

(A-5)

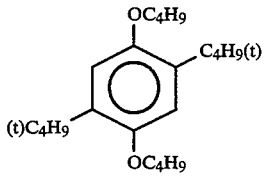

(A-6)

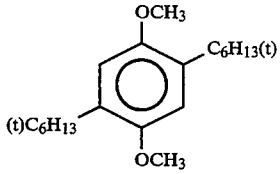

(A-7)

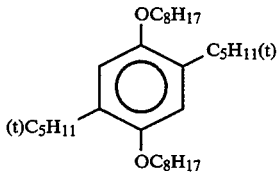

(A-8)

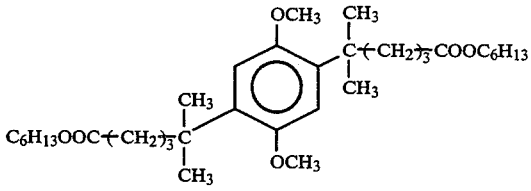

-continued
(A-9)
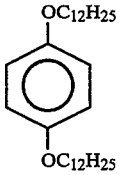
(A-10)
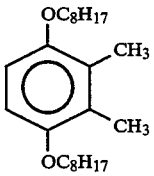
(A-11)
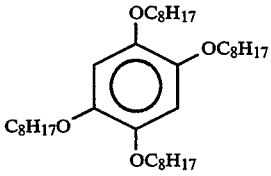
(A-12)
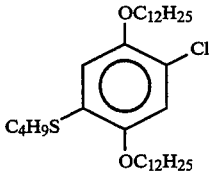
(A-13)
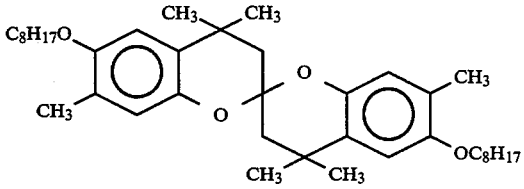
(A-14)
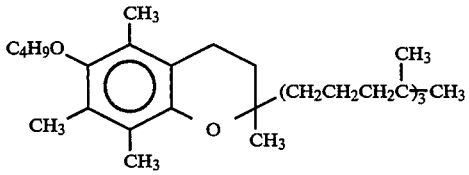
(A-15)
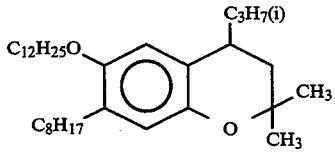
(A-16)
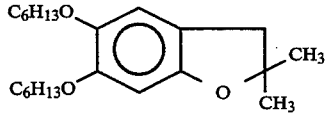
(B-1)
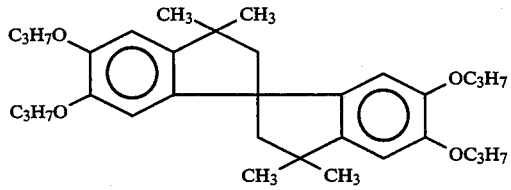

-continued (B-2)

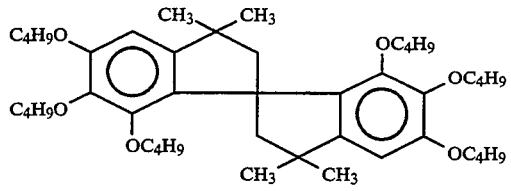

(B-3)

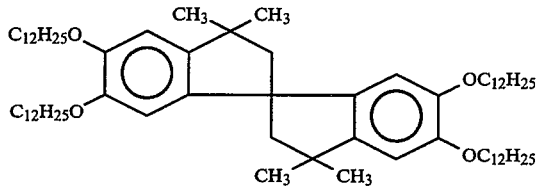

(B-4)

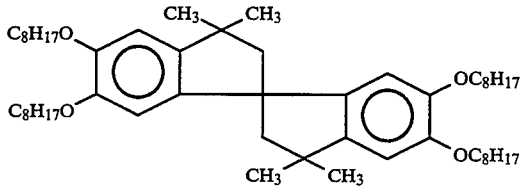

(B-5)

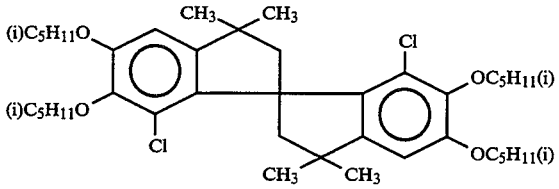

(B-6)

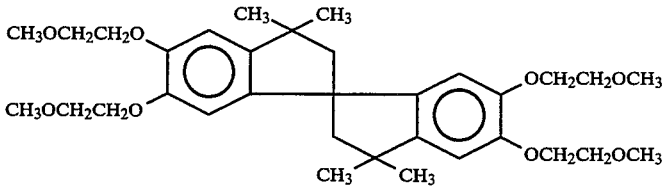

(B-7)

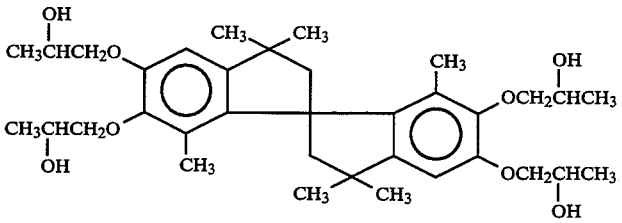

(B-8)

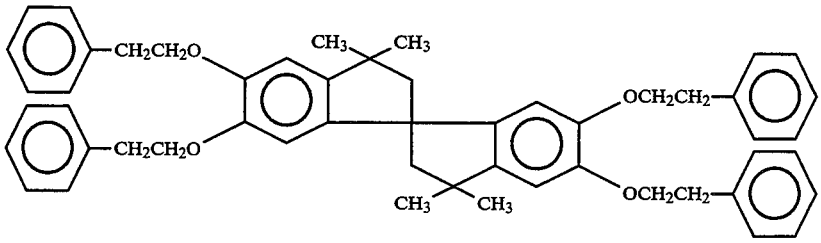

The amount of the compounds represented by formulae (A) r (B) varies depending on the type of the couplers to be used, and is preferably 0.5 to 300 mol %, more preferably 1 to 200 mol %, most preferably 5 to 150 mol % based on the amount of the couplers used in the same layer.

Compounds which release photographically useful residues due to coupling can also be used in the present invention. Preferable DIR couplers which release development inhibitors are disclosed in the patents described in VII-F of Research Disclosure, No. 17643, JP-A-57-151944, JP-A-57-154234, JP-A-60-184248, JP-A-63-37346 and U.S. Pat. Nos. 4,248,962 and 4,782,012.

Preferable couplers which release nucleating agents or development accelerators in image-like forms at the time of development are described in British Patent Nos. 2,097,140 and 2,131,188, and in JP-A-59-157638 and JP-A-59-170840.

Other compounds which can be used in the light-sensitive materials of the present invention include competitive couplers described, for example, in U.S. Pat. No. 4,130,427, multi-equivalent couplers described, for example, in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described, for example, in JP-A-60-185950 and JP-A-62-24252, couplers which release dyes which recolor after elimination described, for example, in European Patent Application No. 173,302A, ligand releasing couplers described, for example, in U.S. Pat. No. 4,553,477, bleaching accelerator releasing couplers described, for example, in Research Disclosure, Nos. 11449, 24241 and in JP-A-61-201247, leuco dye releasing couplers described in JP-A-63-75747, and fluorescent dye releasing couplers described in U.S. Pat. No. 4,774,181.

The standard amount of these couplers to be used in the present invention falls in the range of 0.001 to 1 mol per mol of light-sensitive silver halide, with 0.01 to 0.5 mol for yellow couplers, 0.003 to 0.3 mol for magenta couplers, and 0.002 to 0.3 mol for cyan couplers, per mol of light-sensitive silver halide,respectively, being preferred.

Typical examples of organic anti-fading agents for cyan, magenta and/or yellow images which can be used in combination with the compounds of formula (I) of the present invention include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives of these compounds which are obtained by silylation or alkylation of the phenolic hydroxyl group thereof. Metal complexes typified by (bissalicylaldoxymato)nickel complexes and (bis-N,N-dialkyldithiocarbamato)nickel complexes can also be used.

Specific examples of such organic anti-fading agents include hydroquinones described, for example, in U.S. Pat. Nos. 2,360,290, 2,418,613, 2,700,453, 2,701,197, 2,728,659, 2,732,300, 2,735,765, 3,982,944 and 4,430,425, British Patent No. 1,363,921, U.S. Pat. Nos. 2,710,801 and 2,816,028; 6-hydroxychromans, 5-hydroxychromans and spirochromans described, for example, in U.S. Pat. Nos. 3,432,300, 3,573,050, 3,574,627, 3,698,909 and 3,764,337 and JP-A-52-152225; spiro indanes described in U.S. Pat. No. 4,360,589; p-alkoxyphenols described, for example, in U.S. Pat. No. 2,735,765, British Patent No. 2,066,975, JP-A-59-10539 and JP-B-57-19765; hindered phenols described, for example, in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described, for example, in JP-B-56-21144; hindered amines described, for example, in U.S. Pat. Nos. 3,336,135 and 4,268,593, British Patent Nos. 1,326,889, 1,354,313 and 1,410,846, JP-B-51-1420, JP-A-58-114036, JP-A-59-53846 and JP-A-59-78344; and metal complexes described, for example, in U.S. Pat. Nos. 4,050,938 and 4,241,155 and British Patent No. 2,027,731(A). Each of these compounds is usually coemulsified with each corresponding color coupler in an amount of 5 to 100% by weight based on the amount of the coupler, and the resulting emulsion is added to the light-sensitive emulsion layer, whereby the object can be attained.

The light-sensitive materials according to the present invention may contain hydroquinone derivatives, aminophenol derivatives, gallic acid derivatives and ascorbic acid derivatives as a color anti-foggant.

In order to prevent deterioration of cyan dye images by heat, and especially, by light, more excellent effects can be obtained when an UV absorber is introduced in a cyan color developing layer and adjacent layers on both sides thereof.

Examples of UV absorbers which may be used in the practice of the present invention include benzotriazole compounds substituted by an aryl group (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784 and European Patent Application No. 521,823), cinnamic ester compounds (for example, those described in U.S. Pat. Nos. 3,705,805 and 3,707,395), butadiene compounds (for example, those described in U.S. Pat. No. 4,045,229), benzoxazole compounds (for example, those described in U.S. Pat. Nos. 3,406,070 and 4,271,307) and triazine compounds (for example, those described in JP-A-46-3335 and European Patent Application Nos. 520,938, 530,135 and 531,258). UV absorbent couplers (for example, cyan dye forming couplers of an alpha-naphthol type) and UV absorbent polymers may also be used. These UV absorbers may be mordanted in a specific layer. Of these compounds, the mentioned benzotriazole compounds which are substituted by an aryl group and the mentioned triazine compounds are preferred.

The compounds of formula (I) and couplers according to the present invention can be introduced into a light-sensitive material by a variety of known dispersing methods. In particular, an oil-in-water dispersion method is preferred in which the present compounds are dissolved in a high boiling point organic solvent (a low boiling point organic solvent may also be used, if necessary), emulsified and dispersed in an aqueous gelatin solution and then added to a silver halide emulsion. The compounds represented by formula (I) of the present invention may be used as the high boiling point organic solvent.

Examples of the high boiling point solvents used in oil-in-water dispersion methods are described, for example, in U.S. Pat. No. 2,322,027. Specific examples of the steps of a latex dispersion method, which is an example of a polymer dispersion method, its effects and latexes to be used for impregnation are described, for example, in U.S. Pat. No. 4,199,363, West German Patent (OLS) Nos. 2,541,274 and 2,541,230, JP-B-53-41091 and European Patent Application 029,104A. Dispersing methods utilizing polymers which are soluble in organic solvents are described in PCT International Publication No. WO88/00723.

High boiling point organic solvents which can be used in the mentioned oil-in-water dispersion methods include phthalic esters (for example, dibutyl phthalate, dioctyl phthalate, dicyclohexyl phthalate, di-2-ethylhexyl phthalate, decyl phthalate, bis(2,4-di-tert-amylphenyl)isophthalate and bis(1,1-diethylpropyl)phthalate); esters of phosphoric acid or phosphonic acid (for example, diphenyl phosphate, triphenyl phosphate, tricresyl phosphate, 2-ethylhexyl diphenyl phosphate, dioctylbutyl phosphate, tricyclohexyl phosphate, tri-2-ethylhexyl phosphate, tridodecyl phosphate, and di-2-ethylhexylphenyl phosphate); benzoic esters (for example, 2-ethylhexyl benzoate, 2,4-dichloro benzoate, dodecyl benzoate, and 2-ethylhexyl-p-hydroxy benzoate); amides (for example, N,N-diethyldodecaneamide and N,N-diethyllaurylamide); alcohols and phenols (for example, isostearyl alcohol and 2,4-di-tert-amyl phenol); aliphatic esters (for example, dibutoxyethyl succinate, di-2-ethylhexyl succinate, 2-hexyldecyl tetradecanoate, tributyl citrate, diethyl azelate, isostearyl lactate, and trioctyl citrate); aniline derivatives (for example, N,N-dibutyl-2-butoxy-5-tert-octylaniline); chlorinated paraffins (for example, paraffins containing 10 to 80% chlorine); trimesinic esters (for example, tributyl trimesinate); dodecyl benzene; diisopropylnaphthalene; phenols (for example, 2,4-di-tert-amylphenol, 4-dodecyloxyphenol, 4-dodecyloxycarbonylphenol, and 4-(4-dodecyloxyphenylsulfonyl)phenol); carboxylic acids (for example, 2-(2,4-di-tert-amylphenoxy)butylic acid, and 2-ethoxyoctane decanoic acid; and alkyl phosphoric acids (for example, di-(2-ethylhexyl)phosphoric acid, diphenyl phosphoric acid). Supplementary solvents may also be used in combination which include organic solvents having a boiling point between 30° and about 160° C., such as ethyl acetate, butyl acetate, ethyl propionate, methylethylketone, cyclohexanone, 2-ethoxyethyl acetate and dimethylformamide.

These high boiling point organic solvents can be used in amounts from 0 to 10.0, preferably 0 to 6.0 fold by weight relative to the amount of couplers.

The light-sensitive materials according to the present invention comprise a support having thereon at least one layer which contains at least one of the compounds represented by formula (I).

The light-sensitive materials of the present invention may be formed by applying at least one blue sensitive silver halide emulsion layer, at least one green sensitive silver halide emulsion layer and at least one red sensitive silver halide emulsion layer on a support in that order. However, the silver halide emulsion layers may be applied in a different order. Moreover, an infrared sensitive silver halide emulsion layer may be used in place of at least one of the above-described light-sensitive emulsion layers. When respective silver halide emulsions sensitive to light in each wavelength region, and a color coupler capable of forming a dye which is complementary to the sensitizing light are contained in these light-sensitive emulsion layers, color reproduction can be achieved according to a subtractive color process. However, the color forming hue of the color coupler and the light-sensitive emulsion layer may be such that the above corresponding relation does not hold.

The present compounds can be applied to, for example, color papers, color reversal papers, direct positive color light-sensitive materials, color negative films, color positive films and color reversal films. Of these, preferable applications are color light-sensitive materials having reflecting supports (such as color papers and color reversal papers) and color light-sensitive materials having positive images (such as direct positive color light-sensitive materials, color positive films and color reversal films). Color light-sensitive materials having reflecting supports are particularly preferred.

Examples of silver halides which may be used in the present invention include silver chloride, silver bromide, silver chlorobromide, silver iodochlorobromide and silver iodobromide. Especially for the purpose of expedited processing, it is desirable to use a silver chlorobromide or a pure silver chloride emulsion which substantially does not contain silver iodide and contains silver chloride in an amount of not less than 90 mol %, preferably not less than 95 mol %, still more preferably not less than 98 mol %, based on the amount of the silverhalide.

In order to enhance the sharpness of images, it is preferable to add dyes, which can be decolored by a certain treatment (among these, oxonol type dyes) and which are described in European Patent Application No. 0,337,490A2, pages 27 to 76, into a hydrophilic colloid layer in such amounts that the optical reflection density at the wavelength of 680 nm in the light-sensitive material is not less than 0.70. Alternatively, not less than 12% by weight (more preferably not less than 14% by weight) of titanium oxide grains which are surface-treated with di- to tetra-hydric alcohol (for example, trimethoxyethane), may be included in a waterproof resin layer of the support of the light-sensitive material.

Moreover, the light-sensitive materials according to the present invention preferably contain, along with couplers, a compound which improves color image preservability as described in European Patent Application No. 0,277,589A2. A use of such a compound with pyrazoloazole couplers or pyroloazole couplers of the present invention is particularly preferred.

Namely, compounds (F) and/or compounds (G) are used alone or in combination. The compounds (F) are chemically bonded to aromatic amine type developing agents remaining after color development to form a compound which is chemically inactive and substantially colorless. The compounds (G) are chemically bonded to the oxidation products of the aromatic amine type developing agents remaining after color development to form a compound which is chemically inactive and substantially colorless. When the compounds (F) and/or the compounds (G) are used, the formation of stains due to the formation of a color dye by the reaction of the couplers with the color developing agents or their oxidation products remaining in the layer during storage after processing, or other side effects, can be prevented.

It is preferable that the light-sensitive materials according to the present invention contain anti-fungal agents as described in JP-A-63-271247 for preventing various fungi and bacteria from propagating in a hydrophilic colloid layer and deteriorating the images.

The support which is used in the light-sensitive materials according to the present invention may have, for the purpose of displaying, a white polyester support or a support having a white pigment-containing layer on the support at the side where the silver halide emulsion layer exists. Moreover, it is preferred that an antihalation layer is provided on the support at the side where the silver halide emulsion layer is coated or at the reverse side for improving sharpness. Especially, in order to appreciate the display in both the reflected light and the transmitted light, the transmission density of the support is preferably in the range of 0.35 to 0.8.

The light-sensitive materials of the present invention may be exposed to visible light or infrared light. A low illumination intensity exposure or a high illumination intensity short exposure are both applicable. When the latter is employed, a laser scanning exposure method is preferably used in which, the exposure time per pixel is shorter than $1\times10^{-4}$ second.

Moreover, at the time of exposure, use of a band stop filter described in U.S. Pat. No. 4,880,726 is preferred. The filter eliminates light amalgamation, and therefore color reproductivity is significantly enhanced.

According to the present invention, the light-sensitive materials can be developed by conventional methods described in Research Disclosure, No. 17643, pages 28 and 29 and ibid., No. 18716, page 615, from the left to the right column. For example, the development process includes a color developing step, a desilverization step and a washing step. In the desilverization step, a bleach-fixing treatment step using a bleach-fixing solution may be conducted in place of a combination of a bleaching step using a bleaching solution and a fixing step using a fixing solution. Alternatively, the bleaching step, the fixing step and the bleach-fixing treatment step may be combined in any arbitrary order. A stabilizing step may replace the washing step, or the stabilizing step may follow the washing step. A mono-bath treatment using a mono bath of a development-bleaching-fixing solution can be performed, wherein color developing and bleach-fixing are carried out in a monobath. These processing steps may be effected in combination with a prehardening treatment step, a neutralizing step therefor, a stop and fixing treatment step, a posthardening treatment step, a controlling step, an intensification step, or the like. Between any two of the above steps, an intermediate washing step may arbitrarily be provided. In these processes, a so-called activator treatment step may replace the color developing step.

Preferable examples of the silver halide emulsions and other materials (such as additives) which are employed in the present invention, and photographic constituent layers (arrangement of layers, and the like), methods of processing the light-sensitive materials and additives which may be in the process are described in the patent publications described below, in particular, in European Patent Application No. 0,355,660A2.

TABLE 1

| Photographic constituents, and the like | JP-A-62-215272 | JP-A-2-33144 | EPO No. 355,660A2 |
|---|---|---|---|
| Silver halide emulsions | Page 10, right upper column, line 6 to page 12, left lower column, line 5, and page 12, right lower column, 4th line from the last line to page 13, left upper column, line 17 | Page 28, right upper column, line 16 to page 29, right lower column, line 11, and page 30, line 2 to line 5 | Page 45, line 53 to page 47, line 3, and page 47, line 20 to line 22 |
| Silver halide solvents | Page 12, left lower column, line 6 to line 14, and page 13, left upper column, 3rd line from the last line to page 18, left lower column, the last line | — | — |
| Chemical sensitizers | Page 12, left lower column, 3rd line from the last line to right lower column, 5th line from the last line, and page 18, right lower column, line 1 to page 22, right upper column, 9th line from the last line | Page 29, right lowe column, line 12 to the last line | Page 47, line 4 to line 9 |
| Spectral sensitizers (Spectral sensitizing methods) | Page 22, right upper column, 8th line from the last line to page 38, the last line | Page 30, left upper column, line 1 to line 13 | Page 47, line 10 to line 15 |
| Emulsion stabilizers | Page 39, left upper column, line 1 to page 72, right upper column, the last line | Page 30, left upper column, line 14 to right upper column, line 1 | Page 47, line 16 to line 19 |
| Development accelerators | Page 72, left lower column, line 1 to page 91, right upper column, line 3 | — | — |

TABLE 2

| Photographic constituents, and the like | JP-A-62-215272 | JP-A-2-33144 | EPO No. 355,660A2 |
|---|---|---|---|
| Color couplers (Cyan, magenta, yellow couplers) | Page 91, right upper column, line 4 to page 121, left upper column, line 6 | Page 3, right upper column, line 14 to page 18, left upper column, the last line, and page 30, right upper column, line 6 to page 35, | Page 4, line 15 to line 27, page 5, line 30 to page 28, the last line, page 45, line 29 to line 31, and page 47, line 23 to page 63, |

TABLE 2-continued

| Photographic constituents, and the like | JP-A-62-215272 | JP-A-2-33144 | EPO No. 355,660A2 |
|---|---|---|---|
| | | right lower column, line 11 | line 50 |
| Color increasing agents | Page 121, left upper column, line 7 to page 125, right upper column, line 1 | — | — |
| UV absorbers | Page 125, right upper column, line 2 to page 127, left lower column, the last line | Page 37, right lower column, line 14 to page 38, left upper column, line 11 | Page 65, line 22 to line 31 |
| Anti-fading agents (Image stabilizers) | Page 127, right lower column, line 1 to page 137, left lower column, line 8 | Page 36, right upper column, line 12 to page 37, left upper column, line 19 | Page 4, line 30 to page 5, line 23, page 29, line 1 to page 45, line 25, page 45, line 33 to line 40, and page 65, line 2 to line 21 |
| High B.P. and/or low B.P. organic solvents | Page 137, left lower column, line 9 to page 144, right upper column, the last line | Page 35, right lower column, line 14 to page 36, left upper column, 4th line from the last line | Page 64, line 1 to line 51 |
| Method of dispersing photographic additives | Page 144, left lower column, line 1 to page 146, right upper column, line 7 | Page 27, right lower column, line 10 to page 28, left upper column, the last line, and page 35, right lower column, line 12, to page 36, right upper column, line 7 | Page 63, line 51 to page 64, line 56 |

TABLE 3

| Photographic constituents, and the like | JP-A-62-215272 | JP-A-2-33144 | EPO No. 355,660A2 |
|---|---|---|---|
| Hardening agents | Page 146, right upper column, line 8 to page 155, left lower column, line 4 | — | — |
| Developing agent precursors | Page 155, left lower column, line 5 to page 155, right lower column, line 2 | — | — |
| Development inhibitor releasing compounds | Page 155, right lower column, line 3 to line 9 | — | — |
| Supports | Page 155, right lower column, line 19 to page 156, left upper column, line 14 | Page 38, right upper column, line 18 to page 39, left upper column, line 3 | Page 66, line 29 to page 67, line 13 |
| Constitution of sensitive material layers | Page 156, left upper column, line 15 to page 156, right lower column, line 14 | Page 28, right upper column, line 1 to line 15 | Page 45, line 41 to line 52 |
| Dyes | Page 156, right lower column, line 15 to page 184, right lower column, the last line | Page 38, left upper column, line 12 to right upper column, line 7 | Page 66, line 18 to line 22 |
| Color mixing inhibitors | Page 185, left upper column, line 1 to page 188, right lower column, line 3 | Page 36, right upper column, line 8 to line 11 | Page 64, line 57 to line 65, line 1 |
| Gradation adjusting agents | Page 188, right lower column, line 4 to line 8 | — | — |

TABLE 4

| Photographic constituents, and the like | JP-A-62-215272 | JP-A-2-33144 | EPO No. 355,660A2 |
|---|---|---|---|
| Antistain agents | Page 188, right lower column, line 9 to page 193, right lower column, line 10 | Page 37, left upper column, the last line to right lower column, line 13 | Page 65, line 32 page 66, line 17 |
| Surfactants | Page 201, left lower column, line 1 to page 210, right upper column, the last line | Page 18, right upper column, line 1 to page 24, right lower column, the last line, and page 27, left lower column, 10th line from the last line to right lower column, line 9 | — |
| Fluorine-containing compounds (For use as antistatic agents, coating aids, lubricants, antiadhesive agents, etc.) | Page 210, left lower column, line 1 to page 222, left lower column, line 5 | Page 25, left upper column, line 1 to page 27, right lower column, line 9 | — |
| Binders (Hydrophilic colloids) | Page 222, left lower column, line 6 to page 225, left upper column, the last line | Page 38, right upper column, line 8 to line 18 | Page 66, line 23 to line 28 |
| Thickeners | Page 225, right upper column, line 1 to page 227, right upper column, line 2 | — | — |
| Antistatic agents | Page 227, right upper column, line 3 to page 230, left upper column, line 1 | — | — |

TABLE 5

| Photographic constituents, and the like | JP-A-62-215272 | JP-A-2-33144 | EPO No. 355,660A2 |
|---|---|---|---|
| Polymer latex | Page 230, left upper column, line 2 to page 239, the last line | — | — |
| Matte agents | Page 240, left upper column, line 1 to page 240, right upper column, the last line | — | — |
| Photographic processing methods (processing steps, additives, etc) | Page 3, right upper column, line 7 to page 10, right upper column, line 5 | Page 39, left upper column, line 4 to page 42, left upper column, the last line | Page 67, line 14 to page 69, line 28 |

Note: The cited portions of JP-A-62-215272 include portions which have been amended by an amendment dated March 16, 1987, which is appended to the end of the published specification. Further, it is preferable to use, as yellow couplers among the above mentioned color couplers, so-called yellow couplers of a short wavelength type, which are disclosed in JP-A-63-231451, JP-A-63-123047, JP-A-63-241547, JP-A-1-173499, JP-A-1-213648 and JP-A-1-250944.

The present invention is now explained in detail with reference to the following examples, which however, should not be construed as limiting the invention thereto.

The comparative compounds employed in the examples are as follows:

Comparative compound 1:

$(C_{12}H_{25}SCH_2CH_2CO_2CH_2)_4C$
Compound described in U.S. Pat. No. 4,540,658

Comparative compound 2:

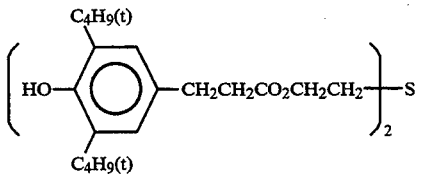

-continued

Compound described in U.S. Pat. No. 4,540,658

Comparative compound 3:

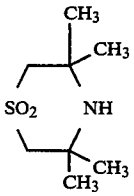

Compound described in British Patent No. 1,410,846

Comparative compound 4:

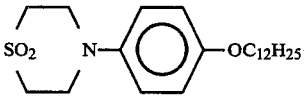

Compound described in U.S. Pat. No. 4,880,733

Comparative compound 5:

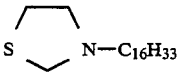

Compound described in JP-A-63-43146

Comparative compound 6:

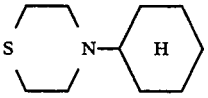

Compound described in European Patent Application No. 178,794A

Comparative compound 7:

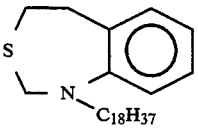

Compound described in JP-A-63-149644

Comparative compound 8:

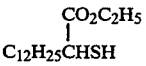

Compound described in U.S. Pat. No. 4,704,350

Comparative compound 9:

$S(CH_2CH_2CO_2C_{12}H_{25})_2$

Compound described in JP-A-62-103642

Comparative compound 10:

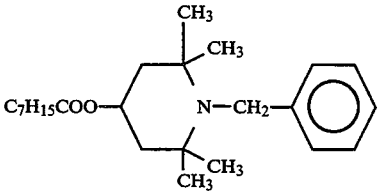

Compound described in JP-A-2-208653

Comparative compound 11:

-continued

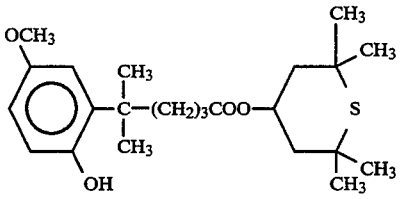

Compound described in JP-A-1-113382

Comparative compound 12:

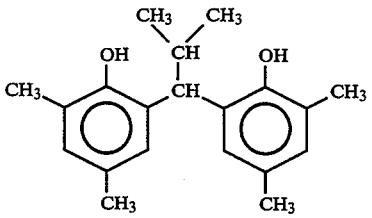

Compound described in JP-A-3-48241, JP-A-3-48845 and JP-A-3-51846

Comparative compound 13:

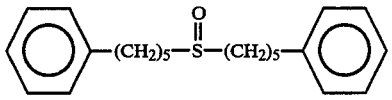

Compound described in European Patent Application No. 509,311A

Comparative compound 14:

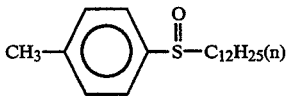

Compound described in European Patent Application No. 509,311A

Comparative compound 15:

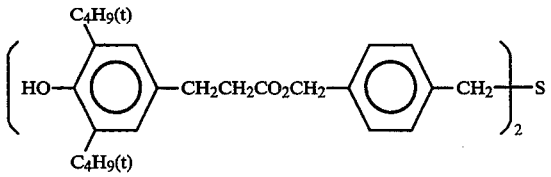

Compound described in U.S. Pat. No. 4,540,658

Comparative compound 16:

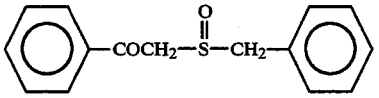

Compound described in JP-A-54-48536

Comparative compound 17:

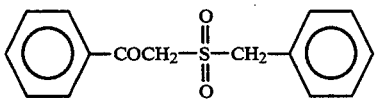

Compound described in JP-A-54-48536

Comparative compound 18:

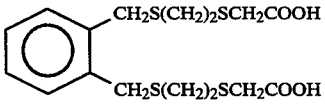

Compound described in JP-A-1-200255

-continued

Comparative compound 19:

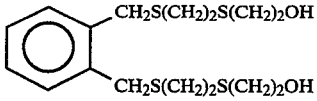

Compound described in JP-A-1-200255

Comparative compound 20:

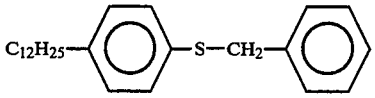

Compound described in JP-A-62-103642

Comparative compound 21:

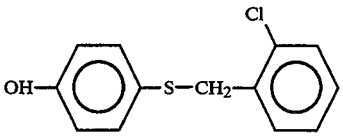

Compound described in JP-A-62-103642

Comparative compound 22:

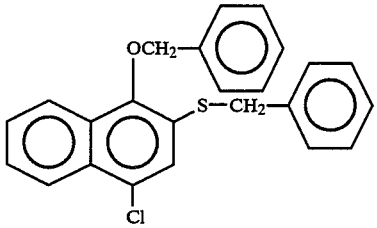

Compound described in JP-A-62-103642

Comparative compound 23:

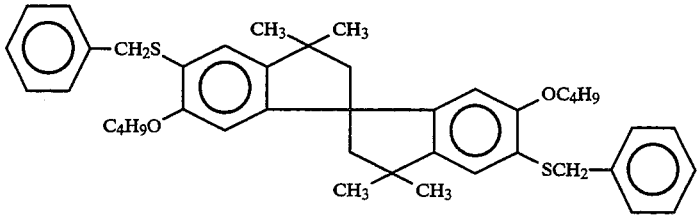

Compound described in JP-A-62-103642

EXAMPLE 1

16.1 g of yellow coupler (Y-1) and 11.5 g of a high boiling point organic solvent, dibutylphthalate, were dissolved in 24 ml of ethyl acetate, and the resulting solution was emulsified in 200 g of a 10% by weight aqueous solution of gelatin containing 1.5 g of sodium dodecylbenzenesulfonate.

The entire amount of the obtained emulsified dispersion was added to 247 g of a high silver halide emulsion (silver: 70.0 g/kg emulsion, content of silver bromide: 0.5 mol %), and the obtained emulsion was applied onto a triacetate film base having an undercoat layer such that the amount of the applied silver was 1.73 g/m$^2$. A gelatin layer was provided on the obtained coated layer as a protective layer so that the thickness of the formed film in a dry state was 1.0 μm. Sample 101 was thus prepared. A sodium salt of 1-oxy-3,5-dichloro-sec-triazine was employed as the gelatin hardening agent.

A procedure similar to that used in the preparation of sample 101 was followed, and coemulsified products were prepared by the combinations of the couplers and color image stabilizers (amounts added: 100 mol % relative to the amount of coupler) shown in Table 6. The thus obtained products were applied onto a film base in a similar manner as that used for sample 101, so as to prepare samples 102 to 144.

Each of the thus obtained samples was subject to wedgewise exposure, and was thereafter subject to a development process according to the following processing steps:

| Processing step | Temperature | Time |
|---|---|---|
| Color development | 35° C. | 45 sec. |

-continued

| Processing step | Temperature | Time |
|---|---|---|
| Bleach-fixing | 30–35° C. | 45 sec. |
| Rinsing (1) | 30–35° C. | 20 sec. |
| Rinsing (2) | 30–35° C. | 20 sec. |
| Rinsing (3) | 30–35° C. | 20 sec. |
| Drying | 70–80° C. | 60 sec. |

The compositions of the respective processing solutions were as follows.

| | |
|---|---|
| Color developing solution: | |
| Water | 800 ml |
| Ethylenediamine-N,N,N',N'-tetramethylenephosphonic acid | 1.5 g |
| Potassium bromide | 0.015 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| Disodium-N,N-bis(sulfonatoethyl)-hydroxylamine | 5.5 g |
| Fluorescent brightener (Whitex 4B, Sumitomo Chemical Co., Ltd.) | 1.0 g |
| Water to make | 1000 ml |
| pH (25° C.) | 10.05 |
| Bleach-fixing solution: | |
| Water | 400 ml |
| Ammonium thiosulfate (700 g/liter) | 100 ml |
| Sodium sulfite | 17 g |
| Ammonium iron (III) ethylenediaminetetraacetate | 55 g |
| Disodium Ethylenediaminetetraacetate | 5 g |
| Ammonium bromide | 40 g |
| Water to make | 1000 ml |
| pH (25° C.) | 6.0 |
| Rinsing solution: | |
| Ion-exchanged water (respective amounts of calcium and magnesium contained therein: not more than 3 ppm) | |

The samples 101 to 144 which formed color images were exposed for eight days to light of a xenon tester (luminous intensity: 200,000 Lux) through an ultraviolet absorbing filter which cuts rays having a wavelength of not more than 400 nm and manufactured by Fuji Photo Film Co., Ltd. The yellow density (stain) of the unexposed part of each sample was measured, and the density residual ratio (initial density: 1.0) was obtained. Measurement was performed with a Fuji automatic recording densitometer.

The results are shown in Table 6.

TABLE 6

| Sample No. | Coupler | Color image stabilizer | Stain | Yellow density residual ratio Initial density 1.0 Xe 200,000 Lux 8 days | Remarks |
|---|---|---|---|---|---|
| 101 | Y-1 | — | 0.16 | 45% | Comparative example |
| 102 | ↓ | Comparative compound 1 | 0.16 | 48% | ↓ |
| 103 | ↓ | Comparative compound 2 | 0.19 | 49% | ↓ |
| 104 | ↓ | Comparative compound 3 | 0.18 | 42% | ↓ |
| 105 | ↓ | Comparative compound 4 | 0.16 | 44% | ↓ |
| 106 | ↓ | Comparative compound 5 | 0.18 | 47% | ↓ |
| 107 | ↓ | Comparative compound 6 | 0.20 | 42% | ↓ |
| 108 | ↓ | Comparative compound 7 | 0.22 | 38% | ↓ |
| 109 | ↓ | Comparative compound 8 | 0.20 | 30% | ↓ |
| 110 | ↓ | Comparative compound 9 | 0.20 | 29% | ↓ |
| 111 | ↓ | Comparative compound 11 | 0.17 | 38% | ↓ |
| 112 | ↓ | Comparative compound 13 | 0.17 | 54% | ↓ |
| 113 | ↓ | Comparative compound 15 | 0.17 | 50% | ↓ |
| 114 | ↓ | Comparative compound 16 | 0.23 | 42% | ↓ |
| 115 | ↓ | Comparative compound 18 | 0.19 | 43% | ↓ |
| 116 | ↓ | I-A-1 | 0.13 | 89% | Present invention |
| 117 | ↓ | I-A-6 | 0.11 | 78% | ↓ |
| 118 | ↓ | I-A-14 | 0.12 | 83% | ↓ |
| 119 | ↓ | I-B-1 | 0.11 | 80% | ↓ |
| 120 | ↓ | I-B-4 | 0.12 | 79% | ↓ |
| 121 | ↓ | I-B-13 | 0.11 | 81% | ↓ |
| 122 | ↓ | I-C-5 | 0.13 | 84% | ↓ |
| 123 | ↓ | I-C-8 | 0.12 | 85% | ↓ |
| 124 | Y-3 | — | 0.16 | 46% | Comparative example |
| 125 | ↓ | Comparative compound 2 | 0.18 | 48% | ↓ |
| 126 | ↓ | Comparative compound 4 | 0.17 | 42% | ↓ |
| 127 | ↓ | Comparative compound 7 | 0.21 | 41% | ↓ |
| 128 | ↓ | Comparative compound 11 | 0.18 | 42% | ↓ |
| 129 | ↓ | Comparative compound 13 | 0.18 | 49% | ↓ |
| 130 | ↓ | I-A-1 | 0.13 | 88% | Present invention |
| 131 | ↓ | I-A-6 | 0.12 | 80% | ↓ |
| 132 | ↓ | I-B-1 | 0.12 | 81% | ↓ |
| 133 | ↓ | I-C-5 | 0.13 | 83% | ↓ |
| 134 | Y-6 | — | 0.16 | 43% | Comparative example |
| 135 | ↓ | Comparative compound 4 | 0.15 | 45% | ↓ |
| 136 | ↓ | Comparative compound 11 | 0.16 | 49% | ↓ |
| 137 | ↓ | Comparative compound 12 | 0.17 | 47% | ↓ |
| 138 | ↓ | Comparative compound 15 | 0.17 | 50% | ↓ |
| 139 | ↓ | Comparative compound 17 | 0.17 | 41% | ↓ |
| 140 | ↓ | Comparative compound 19 | 0.17 | 44% | ↓ |
| 141 | ↓ | I-A-1 | 0.11 | 87% | Present invention |
| 142 | ↓ | I-A-14 | 0.12 | 83% | ↓ |
| 143 | ↓ | I-B-4 | 0.12 | 86% | ↓ |

TABLE 6-continued

| Sample No. | Coupler | Color image stabilizer | Stain | Yellow density residual ratio Initial density 1.0 Xe 200,000 Lux 8 days | Remarks |
|---|---|---|---|---|---|
| 144 | ↓ | I-C-5 | 0.11 | 85% | ↓ |

From the above results, it is apparent that the compounds of the present invention are effective in preventing fading of color images due to light, and further, are effective for preventing yellowing of the unexposed part of the film. The results revealed excellent preventive effects that were never expected from the conventionally known compounds.

absorbing filter which cuts rays having a wavelength of not more than 400 nm and manufactured by Fuji Photo Film Co., Ltd. The yellow density (stain) of the unexposed part of each sample was measured, and the density residual ratio (initial density: 1.0) was obtained. Measurement was performed with a Fuji automatic recording densitometer.

The results are shown in Table 7.

TABLE 7

| Sample No. | Coupler | Color image stabilizer | Stain | Magenta density residual ratio Initial density 1.0 Xe 200,000 Lux 10 days | Remarks |
|---|---|---|---|---|---|
| 201 | M-1 | — | 0.15 | 6% | Comparative example |
| 202 | ↓ | Comparative compound 2 | 0.16 | 48% | ↓ |
| 203 | ↓ | Comparative compound 9 | 0.17 | 47% | ↓ |
| 204 | ↓ | Comparative compound 13 | 0.16 | 41% | ↓ |
| 205 | ↓ | Comparative compound 20 | 0.17 | 504 | ↓ |
| 206 | ↓ | Comparative compound 21 | 0.18 | 51% | ↓ |
| 207 | ↓ | Comparative compound 23 | 0.17 | 45% | ↓ |
| 208 | ↓ | I-A-2 | 0.12 | 78% | Present invention |
| 209 | ↓ | I-A-6 | 0.12 | 77% | ↓ |
| 210 | ↓ | I-B-3 | 0.13 | 76% | ↓ |
| 211 | ↓ | I-C-2 | 0.12 | 80% | ↓ |
| 212 | M-4 | — | 0.15 | 11% | Comparative example |
| 213 | ↓ | Comparative compound 9 | 0.17 | 53% | ↓ |
| 214 | ↓ | Comparative compound 14 | 0.16 | 404 | ↓ |
| 215 | ↓ | Comparative compound 21 | 0.16 | 51% | ↓ |
| 216 | ↓ | Comparative compound 22 | 0.17 | 43% | ↓ |
| 217 | ↓ | Comparative compound 23 | 0.16 | 44% | ↓ |
| 218 | ↓ | I-A-4 | 0.11 | 79% | Present invention |
| 219 | ↓ | I-A-7 | 0.12 | 77% | ↓ |
| 220 | ↓ | I-B-6 | 0.13 | 78% | ↓ |
| 221 | ↓ | I-B-8 | 0.12 | 79% | ↓ |
| 222 | ↓ | I-C-9 | 0.12 | 79% | ↓ |
| 223 | M-8 | — | 0.19 | 7% | Comparative example |
| 224 | ↓ | Comparative compound 11 | 0.19 | 41% | ↓ |
| 225 | ↓ | I-A-5 | 0.13 | 80% | Present invention |
| 226 | ↓ | I-B-2 | 0.13 | 81% | ↓ |
| 227 | ↓ | I-B-4 | 0.14 | 80% | ↓ |
| 228 | ↓ | I-C-7 | 0.14 | 79% | ↓ |

EXAMPLE 2

A procedure similar to that of Example 1, in which sample 101 was prepared, was followed except that 16.1 g of magenta coupler (M-1) was used in place of yellow coupler and, instead of the high boiling point organic solvent, dibutylphthalate, an equivalent weight of tricresyl phosphate was used. sample 201 was thus prepared.

A similar procedure for the preparation of sample 201 was followed, and coemulsified products were prepared by the combinations of couplers and color image stabilizers (amounts added: 100 mol % relative to the amount of coupler) shown in Table 7. Samples 202 to 228 were thus prepared.

The comparative compounds are the same as those used in Example 1.

Each of the thus obtained samples was exposed to light and then subject to developing processing in a similar manner to Example 1.

The samples 201 to 228 which formed color images were exposed for ten days to light of a xenon tester (luminous intensity: 200,000 Lux) through an ultraviolet From the results in Table 7, it is apparent that the compounds of the present invention are also effective for preventing fading of color images when a magenta coupler is used. Further, the results are remarkably excellent compared to the comparative compounds.

EXAMPLE 3

A procedure similar to that of Example 2, in which sample 201 was prepared, was followed, and coemulsified products were prepared by the combinations of the couplers, color image stabilizers (1) (amounts added: 100 mol % relative to the amount of coupler) and color image stabilizers (2) (amounts added: 200 mol % relative to the amount of coupler) shown in Table 8. Samples 301 to 331 were thus prepared.

The comparative compounds are the same as those used in Example 1.

Each of the thus obtained samples was exposed to light and then subject to developing processing in a similar manner to Example 1.

The samples 301 to 331 which formed color images were exposed for eight days to light of a xenon tester (luminous intensity: 200,000 Lux) through an ultraviolet absorbing filter which cuts rays having a wavelength of not more than 400 nm and manufactured by Fuji Photo Film Co., Ltd. The density residual ratios (initial densities: 1.0 and 0.5) of each sample were measured.

Measurement was performed with a Fuji automatic recording densitometer. The results are shown in Table 8.

TABLE 8

| Sample No. | Coupler | Color image stabilizer (1) | Color image stabilizer (2) | Magenta density residual ratios (Xe 200,000 Lux 8 days) Initial density 1.0 | Initial density 0.5 | Remarks |
|---|---|---|---|---|---|---|
| 301 | M-1 | — | — | 24% | 16% | Comparative example |
| 302 | ↓ | A-2 | Comparative compound 1 | 67% | 53% | ↓ |
| 303 | ↓ | A-6 | Comparative compound 2 | 68% | 50% | ↓ |
| 304 | ↓ | A-13 | Comparative compound 3 | 68% | 45% | ↓ |
| 305 | ↓ | B-1 | Comparative compound 9 | 70% | 41% | ↓ |
| 306 | ↓ | B-6 | Comparative compound 14 | 68% | 46% | ↓ |
| 307 | ↓ | B-7 | Comparative compound 20 | 69% | 42% | ↓ |
| 308 | ↓ | B-8 | Comparative compound 23 | 71% | 47% | ↓ |
| 309 | ↓ | A-2 | I-A-1 | 86% | 85% | Present invention |
| 310 | ↓ | A-6 | I-A-12 | 85% | 84% | ↓ |
| 311 | ↓ | A-13 | I-B-1 | 84% | 83% | ↓ |
| 312 | ↓ | B-1 | I-C-5 | 84% | 84% | ↓ |
| 313 | ↓ | B-6 | I-C-16 | 83% | 83% | ↓ |
| 314 | M-4 | — | — | 26% | 17% | Comparative example |
| 315 | ↓ | A-4 | Comparative compound 2 | 69% | 47% | ↓ |
| 316 | ↓ | A-10 | Comparative compound 6 | 67% | 45% | ↓ |
| 317 | ↓ | A-15 | Comparative compound 7 | 68% | 46% | ↓ |
| 318 | ↓ | B-4 | Comparative compound 8 | 70% | 47% | ↓ |
| 319 | ↓ | B-6 | Comparative compound 21 | 58% | 48% | ↓ |
| 320 | ↓ | B-8 | Comparative compound 22 | 57% | 46% | ↓ |
| 321 | M-4 | A-4 | I-A-4 | 85% | 83% | Present invention |
| 322 | ↓ | A-10 | I-A-16 | 84% | 84% | ↓ |
| 323 | ↓ | A-15 | I-B-12 | 83% | 83% | ↓ |
| 324 | ↓ | B-4 | I-C-2 | 86% | 84% | ↓ |
| 325 | M-7 | — | — | 18% | 11% | Comparative example |
| 326 | ↓ | A-1 | Comparative compound 1 | 64% | 40% | ↓ |
| 327 | ↓ | A-8 | Comparative compound 2 | 62% | 41% | ↓ |
| 328 | ↓ | B-7 | Comparative compound 13 | 65% | 43.% | ↓ |
| 329 | ↓ | A-1 | I-A-19 | 84% | 83% | Present invention |
| 330 | ↓ | A-8 | I-B-8 | 84% | 84% | ↓ |
| 331 | ↓ | B-7 | I-C-3 | 85% | 84% | ↓ |

From the results in Table 8, it is apparent that the compounds of the present invention are also effective for preventing fading of color images when a magenta coupler is used. Further, the results are remarkably excellent compared to the comparative compounds.

EXAMPLE 4

A procedure similar to that of Example 2, in which sample 201 was prepared, was followed except that 9.8 g of cyan coupler (C-1) was used instead of the magenta coupler. Sample 401 was thus prepared.

A similar procedure for the preparation of sample 401 was followed, and coemulsified products were prepared by the combinations of couplers and color image stabilizers (amounts added: 100 mol % relative to the amount of coupler) shown in Table 9. Samples 402 to 430 were thus prepared.

The comparative compounds are the same as those used in Example 1.

Each of the thus obtained samples was exposed to light and then subject to developing processing in a similar manner to Example 1. The samples 401 to 430 which formed color images were exposed for eight days to light of a xenon tester (luminous intensity: 200,000 Lux) through an ultraviolet absorbing filter which cuts rays having a wavelength of not more than 400 nm and manufactured by Fuji Photo Film Co., Ltd. The yellow density (stain) of the unexposed part of each sample was measured and the density residual ratio (initial density: 1.0) was obtained.

Measurement was performed with a Fuji automatic recording densitometer.

The results are shown in Table 9.

TABLE 9

| Sample No. | Coupler | Color image stabilizer | Stain | Cyan density residual ratio Initial density 1.0 Xe 200,000 Lux 8 days | Remarks |
|---|---|---|---|---|---|
| 401 | C-1 | — | 0.16 | 45% | Comparative example |
| 402 | ↓ | Comparative compound 3 | 0.18 | 48% | ↓ |
| 403 | ↓ | Comparative compound 9 | 0.19 | 47% | ↓ |
| 404 | ↓ | Comparative compound 13 | 0.20 | 46% | ↓ |
| 405 | ↓ | I-A-1 | 0.11 | 87% | Present invention |
| 406 | ↓ | I-A-6 | 0.11 | 86% | ↓ |
| 407 | ↓ | I-B-1 | 0.11 | 854 | ↓ |
| 408 | ↓ | I-B-4 | 0.12 | 86% | ↓ |
| 409 | ↓ | I-C-5 | 0.12 | 82% | ↓ |

TABLE 9-continued

| Sample No. | Coupler | Color image stabilizer | Stain | Cyan density residual ratio Initial density 1.0 Xe 200,000 Lux 8 days | Remarks |
|---|---|---|---|---|---|
| 410 | ↓ | I-C-8 | 0.11 | 83% | ↓ |
| 411 | C-7 | — | 0.15 | 44% | Comparative example |
| 412 | ↓ | Comparative compound 6 | 0.16 | 46% | ↓ |
| 413 | ↓ | Comparative compound 8 | 0.15 | 48% | ↓ |
| 414 | ↓ | Comparative compound 11 | 0.20 | 47% | ↓ |
| 415 | ↓ | I-A-1 | 0.11 | 89% | Present invention |
| 416 | ↓ | I-A-14 | 0.12 | 87% | ↓ |
| 417 | ↓ | I-B-1 | 0.12 | 89% | ↓ |
| 418 | ↓ | I-B-13 | 0.11 | 86% | ↓ |
| 419 | ↓ | I-C-5 | 0.12 | 85% | ↓ |
| 420 | ↓ | I-C-8 | 0.12 | 86% | ↓ |
| 421 | C-16 | — | 0.20 | 42% | Comparative example |
| 422 | ↓ | Comparative compound 9 | 0.19 | 45% | ↓ |
| 423 | ↓ | Comparative compound 11 | 0.17 | 46% | ↓ |
| 424 | ↓ | Comparative compound 13 | 0.18 | 43% | ↓ |
| 425 | ↓ | I-A-1 | 0.11 | 88% | Present invention |
| 426 | ↓ | I-A-19 | 0.11 | 86% | ↓ |
| 427 | ↓ | I-B-4 | 0.11 | 85% | ↓ |
| 428 | ↓ | I-B-13 | 0.12 | 83% | ↓ |
| 429 | ↓ | I-C-8 | 0.12 | 86% | ↓ |
| 420 | ↓ | I-C-13 | 0.12 | 87% | ↓ |

From the results in Table 9, it is apparent that the compounds of the present invention are also effective for preventing fading of color images when a cyan coupler is used. Further, the results are remarkably excellent compared to the comparative compounds.

EXAMPLE 5

A surface of a paper support, both sides of which were laminated with polyethylene, was submitted to a corona discharging treatment. Thereafter, a gelatin undercoat layer containing sodium dodecylbenzenesulfonate was provided thereon. Furthermore, various photographic constituent layers were formed on the gelatin undercoat layer so as to prepare a multilayer color printing paper 101 having the layer structure described below. The coating solutions were prepared in the following manner.

Preparation of coating solution for the first layer 153.0 g of yellow coupler (ExY) was dissolved in 25.0 g of a solvent (Solv-1), 25 g of another solvent (Solv-2) and 180 ml of ethyl acetate. The obtained solution was emulsified in 1000 g of 10% aqueous gelatin solution containing 60 ml of 10% sodium dodecylbenzenesulfonate and 10 g of citric acid so as to prepare an emulsified dispersion A. Separately, a silver chlorobromide emulsion A was prepared (cubic; a 3:7 mixture (molar ratio based on silver) of large grain emulsion A having an average grain size of 0.88 μm and small grain emulsion A having an average grain size of 0.70 μm; the variation coefficients of the grain size distributions being 0.08 and 0.10, respectively; and both emulsions containing 0.3 mol % of silver bromide deposited locally on part of the grain surface). To the silver chlorobromide emulsion A was added blue-sensitive spectral sensitizing dyes A and B in amounts of $2.0\times10^{-4}$ mol per mol of silver for the large grain emulsion A, and $2.5\times10^{-4}$ mol per mol of silver for the small grain emulsion A, respectively. The emulsion was chemically ripened by a sulfur sensitizer and a gold sensitizer being added thereto. The above emulsified dispersion A and the silver chlorobromide emulsion A were mixed and dissolved to prepare a coating solution for the first layer having the composition to be described later.

Preparation of a coating solution for the fifth layer 33.0 g of cyan coupler (ExC), 10.0 g of UV absorber (UV-2), 0.6 g of color image stabilizer (Cpd-9), 0.6 g of color image stabilizer (Cpd-10), 0.6 g of color image stabilizer (Cpd-11), 0.6 g of color image stabilizer (Cpd-8), 0.6 g of color image stabilizer (Cpd-6), 18.0 g of color image stabilizer (Cpd-1) and 28 ml of high boiling point organic solvent (Solv-3) were added to 33 ml of ethyl acetate and dissolved. The obtained solution was added to 270 ml of 20% aqueous gelatin solution containing 7.0 g of sodium dodecylbenzenesulfonate, which was then emulsfied and dispersed with a high speed mixer to prepare an emulsified dispersion C. Separately, a silver chlorobromide emulsion C was prepared (cubic; a 1:4 mixture (molar ratio based on silver) of large grain emulsion C having an average grain size of 0.50 μm and small grain emulsion C having an average grain size of 0.41 μm; the variation coefficients of the grain size distributions being 0.09 and 0.11, respectively; both emulsions containing silver halide grains having 0.8 mol % of silver bromide deposited locally on part of the grain surface, and the remaining part being silver chloride). To the silver chlorobromide emulsion C was added red-sensitive spectral sensitizing dye E in an amount of $0.9\times10^{-4}$ mol per mol of silver halide for the large grain emulsion, and $1.1\times10^{-4}$ mol per mol of silver halide for the small grain emulsion. The compound F described below was further added thereto in an amount of $2.6\times10^{-3}$ mol per mol of silver halide. The emulsion was chemically ripened by a sulfur sensitizer and a gold sensitizer being added thereto. The above emulsified dispersion C and red sensitive silver chlorobromide emulsion C were mixed and dissolved to prepare a coating solution for the fifth layer having the composition to be described later.

Coating solutions for the second to fourth layers, the sixth layer, and the seventh layer were prepared in the same manner as the coating solution for the first layer. 1-Hydroxy-3,5-dichloro-sec-triazine sodium salt was used as a gelatin hardener for each layer.

Cpd-14 and Cpd-15 were added to each layer such that their total amounts were 25.0 mg/m$^2$ and 50.0 mg/m$^2$, respectively.

The following spectral sensitizing dyes were used for the silver chlorobromide emulsion of the respective light-sensitive emulsion layers.

TABLE 10

| Blue-sensitive emulsion layer |
|---|
| Sensitizing dye A |

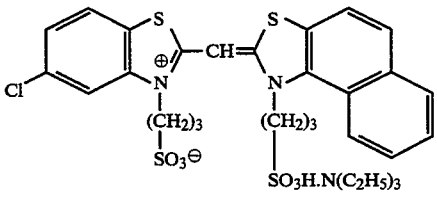

TABLE 10-continued

| Blue-sensitive emulsion layer |
|---|
| and |
| Sensitizing dye B |

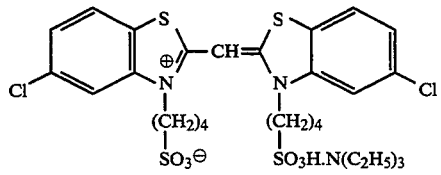

TABLE 11

| Green-sensitive emulsion layer |
|---|
| Sensitizing dye C |

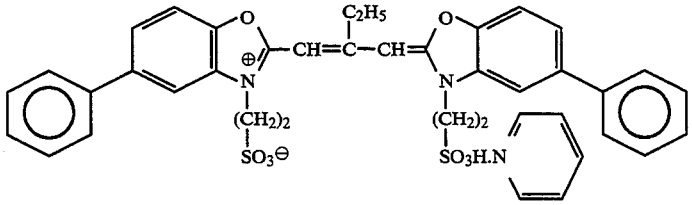

($4.0 \times 10^{-4}$ mol/mol of silver halide for large grain emulsion B, and $5.6 \times 10^{-4}$ mol/mol of silver halide for small grain emulsion B)

Sensitizing dye D

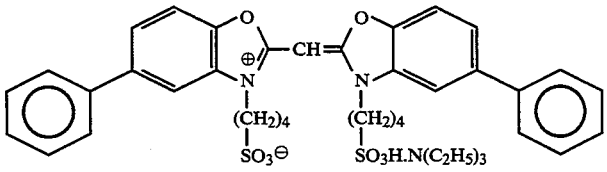

($7.0 \times 10^{-5}$ mol/mol of silver halide for large grain emulsion B, and $1.0 \times 10^{-5}$ mol/mol of silver halide for small grain emulsion B)

TABLE 12

| Red-sensitive emulsion layer |
|---|
| Sensitizing dye E |

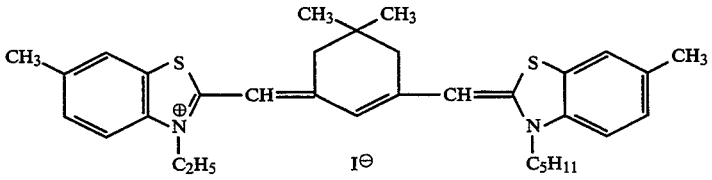

Compound F

TABLE 12-continued

| Red-sensitive emulsion layer |
|---|
| 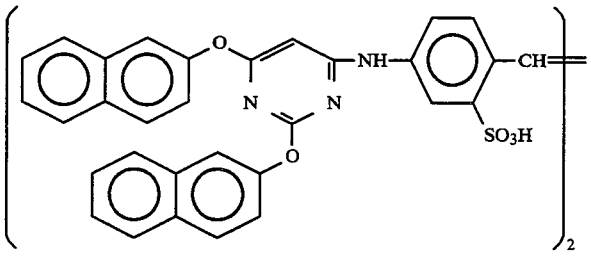 |

Moreover, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetrazaindene was added to the blue-sensitive emulsion layer and the green-sensitive emulsion layer in amounts of $1\times10^{-4}$ mol and $2\times10^{-4}$ mol per mol of silver halide, respectively.

For the prevention of irradiation, the following dyes were added to the emulsion layers (amounts of coating are indicated in parentheses).

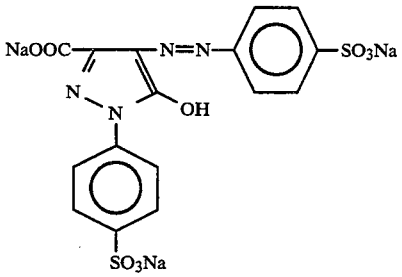

(10 mg/m²)

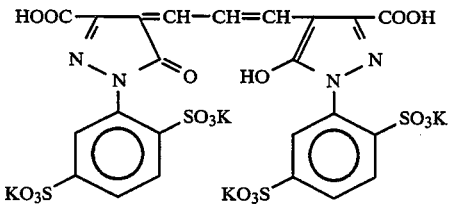

(10 mg/m²)

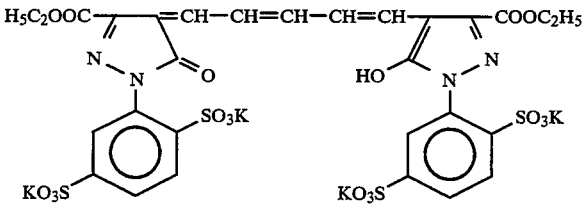

(40 mg/m²)

and

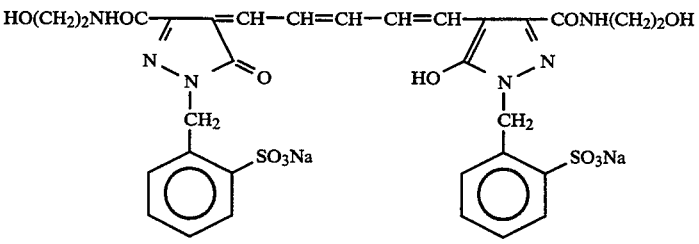

(20 mg/m²)

Layer structure

The composition for each of the layers is shown below. The numerals represent the coating amount ($g/m^2$). For the silver halide emulsions, the numerals indicate coated weights converted to silver.

TABLE 13

| | |
|---|---|
| Support | |
| Polyethylene laminated paper | |
| [Polyethylene on the first layer side contains white pigment ($TiO_2$) and blue-tinted dye (ultramarine)] | |
| First layer (Blue-sensitive emulsion layer) | |
| Above-described silver chlorobromide emulsion A | 0.27 |
| Gelatin | 1.36 |
| Yellow coupler (ExY) | 0.79 |
| Solvent (Solv-1) | 0.13 |
| Solvent (Solv-2) | 0.13 |
| Second layer (Color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |

TABLE 14

| | |
|---|---|
| Third layer (Green-sensitive emulsion layer) | |
| Silver chlorobromide (Cubic, 1:3 mixture (molar ratio based on silver) of large grain emulsion B having an average grain size of 0.55 μm and small grain emulsion B having an average grain size of 0.39 μm. Variation coefficients of the grain size distribution are 0.10 and 0.08, respectively. Both emulsions contain 0.8 mol % of AgBr deposited locally on part of the grain surface.) | 0.13 |
| Gelatin | 1.45 |
| Magenta coupler (ExM) | 0.16 |
| Color image stabilizer (Cpd-5) | 0.15 |
| Color image stabilizer (Cpd-2) | 0.03 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (Color mixing inhibiting layer) | |
| Gelatin | 0.70 |

TABLE 14-continued

| | |
|---|---|
| Color mixing inhibitor (Cpd-4) | 0.04 |
| Solvent (Solv-7) | 0.02 |
| Solvent (Solv-2) | 0.18 |
| Solvent (Solv-3) | 0.18 |

TABLE 15

| | |
|---|---|
| Fifth layer (Red-sensitive emulsion layer) | |
| Silver chlorobromide emulsion (Cubic, 1:4 mixture (molar ratio based on silver) of large grain emulsion C having an average grain size of 0.50 μm and small grain emulsion C having an average grain size of 0.41 μm. Variation coefficients of the grain size distribution are 0.09 and 0.11, respectively. Both emulsions contain 0.8 mol % of AgBr deposited locally on part of the grain surface. The residue of the grain is silver chloride.) | 0.09 |
| Gelatin | 0.85 |
| Cyan coupler (ExC) | 0.33 |
| UV absorber (UV-2) | 0.10 |
| Color image stabilizer (Cpd-9) | 0.006 |
| Color image stabilizer (Cpd-10) | 0.006 |
| Color image stabilizer (Cpd-11) | 0.006 |
| Solvent (Solv-3) | 0.29 |
| Color image stabilizer (Cpd-8) | 0.006 |
| Color image stabilizer (Cpd-6) | 0.006 |
| Color image stabilizer (Cpd-1) | 0.18 |
| Sixth layer (UV absorbing layer) | |
| Gelatin | 0.55 |
| UV absorber (UV-1) | 0.38 |
| Color image stabilizer (Cpd-12) | 0.15 |
| Color image stabilizer (Cpd-5) | 0.02 |

TABLE 16

| | |
|---|---|
| Seventh layer (Protective layer) | |
| Gelatin | 1.13 |
| Acrylic modified copolymer of polyvinyl alcohol (Degree of modification: 17%) | 0.05 |
| Liquid paraffin | 0.02 |
| Color image stabilizer (Cpd-13) | 0.01 |

The chemical structures of the compounds used for preparing the multilayer color photographic printing papers are shown below.

(ExY) Yellow coupler

Mixture (1:1 in molar ratio) of

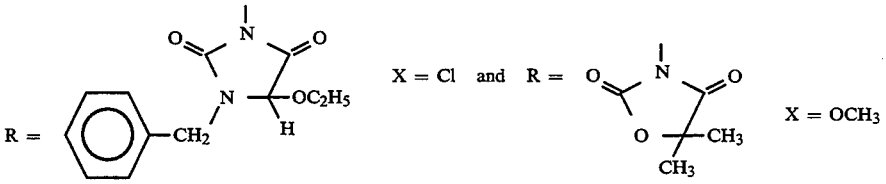

of the following formula

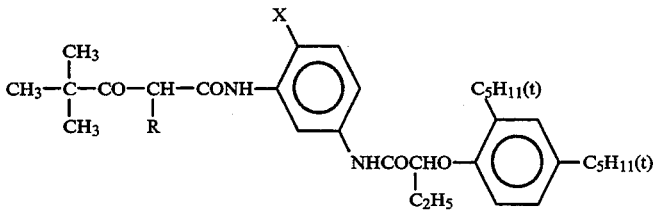

(ExM) Magenta coupler

-continued

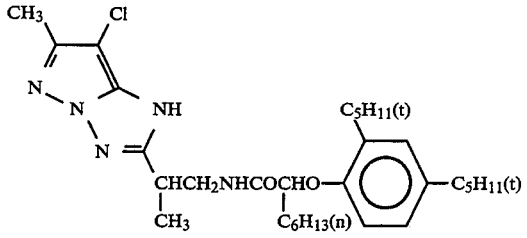

(ExC) Cyan coupler

Mixture (3:7 in molar ratio) of

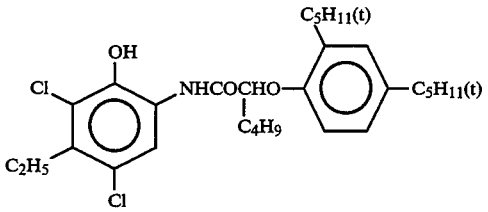

and

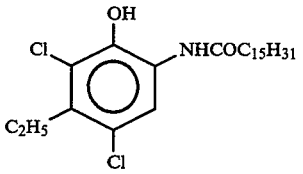

(Cpd-1) Color image stabilizer (Cpd-2) Color image stabilizer

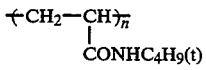

Average molecular weight: 60,000

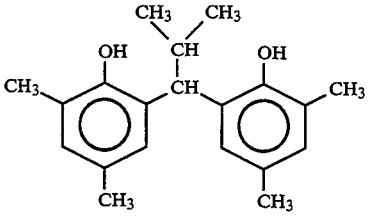

(Cpd-3) Color image stabilizer (Cpd-4) Color mixing inhibitor

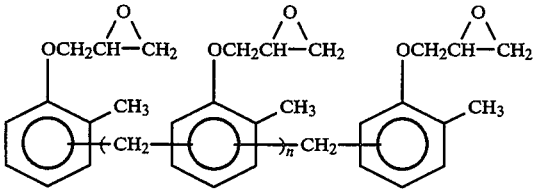

n =7~8 (average value)

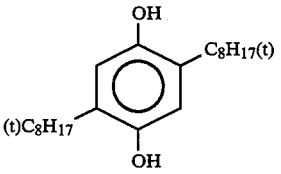

(Cpd-5) Color image stabilizer (Cpd-6) Color image stabilizer

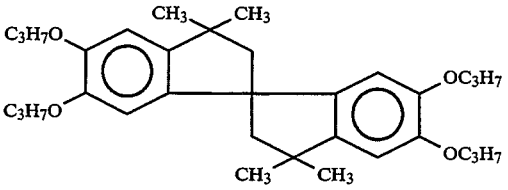

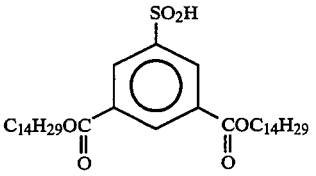

(Cpd-7) Color image stabilizer (Cpd-8) Color image stabilizer

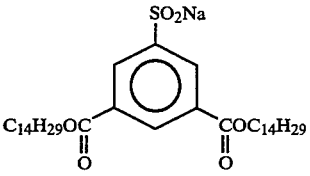

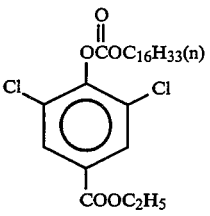

(Cpd-9) Color image stabilizer (Cpd-10) Color image stabilizer

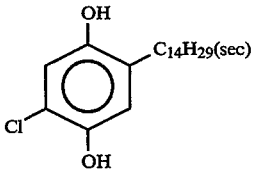
(Cpd-11) Color image stabilizer
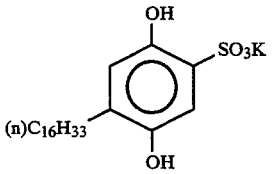
-continued
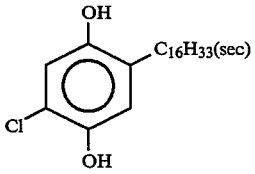
(Cpd-12) Color image stabilizer
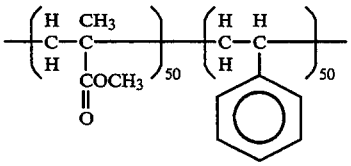
Average molecular weight: 60,000
(Cpd-13) Color image stabilizer
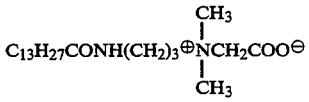
(Cpd-14) Preservative
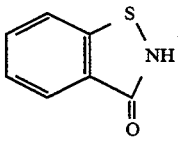
(Cpd-15) Preservative
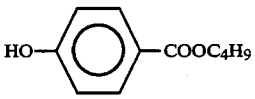
(UV-1) UV absorber
Mixture (10:5:1:5 in weight ratio) of
(1)
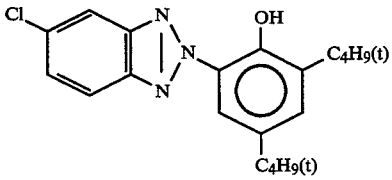
(2)
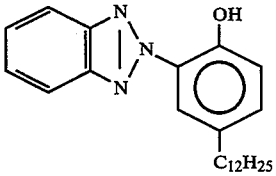
(3)
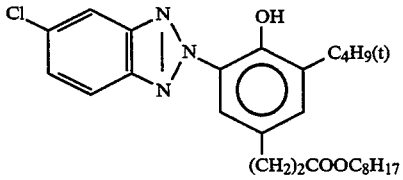
and
(4)
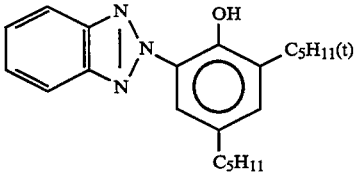
(UV-2) UV absorber
Mixture (1:2:2 in weight ratio) of
(1)
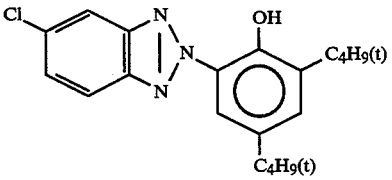
(2)
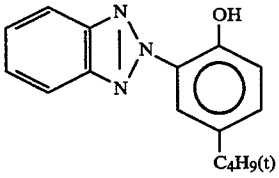
and -continued (3)

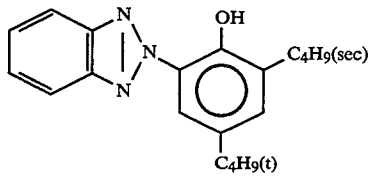

(Solv-1) Solvent

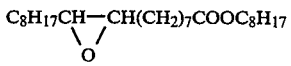

(Solv-2) Solvent

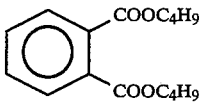

(Solv-3) Solvent

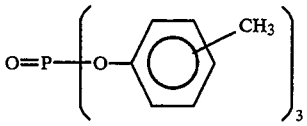

(Solv-4) Solvent

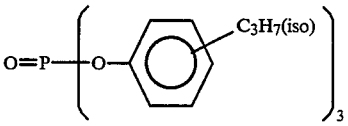

(Solv-5) Solvent

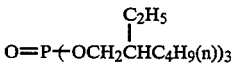

(Solv-6) Solvent

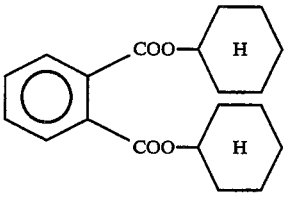

(Solv-7) Solvent

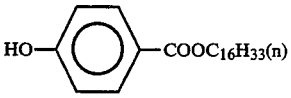

Each sample was subjected to gradation exposure using a sensitometer (manufactured by Fuji Photo Film, Co., Ltd., FWH type, color temperature of the light source 3200° K.) through a three color dissolution filter for sensitometry. Exposure was carried out at an exposure amount of 250 MSC with an exposure time of 1/10 sec.

The samples which were subject to exposure were processed with a paper processing machine following the steps described hereinafter and using the processing solutions having the compositions described hereinafter. Processing was effected continuously until twice an amount of the tank capacity of the color developing tank was replenished (running test).

TABLE 17

| Processing step | Temperature | Time | Replenisher* | Tank capacity |
|---|---|---|---|---|
| Color development | 35° C. | 45 sec. | 161 ml | 1 liter |
| Bleach-fixing | 35° C. | 45 sec. | 215 ml | 1 liter |
| Stabilization (1) | 35° C. | 20 sec. | — | 0.6 liter |
| Stabilization (2) | 35° C. | 20 sec. | — | 0.6 liter |
| Stabilization (3) | 35° C. | 20 sec. | — | 0.6 liter |
| Stabilization (4) | 35° C. | 20 sec. | 248 ml | 0.6 liter |

TABLE 17-continued

| Processing step | Temperature | Time | Replenisher* | Tank capacity |
|---|---|---|---|---|
| Drying | 80° C. | 60 sec. | | |

*: Amount of replenisher is amount per 1 $m^2$ of light-sensitive material

A 4-tank countercurrent system from tank (4) to tank (1) was employed in the stabilizing steps.

The compositions of the processing solutions are as follows.

TABLE 18

| Color developing solution | Tank solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamide ethyl)-3-methyl-4-aminoaniline sulfate | 5.0 g | 7.0 g |
| N,N-bis(carboxymethyl)hydrazine | 4.0 g | 5.0 g |
| N,N-di(sulfoethyl)hydroxylamine.1Na | 4.0 g | 5.0 g |
| Fluorescent brighteniner (WHITEX 4B, product of Sumitomo Chemical Co., Ltd.) | 1.0 g | 2.0 g |
| Water to make | 1000 ml | 1000 ml |

TABLE 18-continued

| Color developing solution | Tank solution | Replenisher |
|---|---|---|
| pH (25° C.) | 10.05 | 10.45 |

TABLE 19

| | |
|---|---|
| Bleach-fixing solution (Tank solution and replenisher are the same.) | |
| Water | 400 ml |
| Ammonium thiosulfate (700 g/liter) | 100 ml |
| Sodium sulfite | 17 g |
| Ammonium iron (III) ethylenediaminetetraacetate | 55 g |
| Disodium ethylenediaminetetraacetate | 5 g |
| Ammonium bromide | 40 g |
| Water to make | 1000 ml |
| pH (25° C.) | 6.0 |
| Stabilizer (Tank solution and replenisher are the same.) | |
| Benzoisothiazoline-3-one | 0.02 g |
| Polyvinyl pyrolidone | 0.05 g |
| Water to make | 1000 ml |
| pH (25° C.) | 7.40 |

The thus obtained sample was taken as sample 1A, and a similar procedure for preparing sample 1A was followed to prepare other samples 2A to 8A except that the yellow coupler in the first layer was combined as shown in Table 20 for coemulsification. In the samples, the respective constituent compounds were replaced in equimolar amounts.

The comparative compounds are the same as in Example 1.

Each sample which formed color images thereon was subjected to a discoloration test. The anti-fading performance was evaluated with a xenon tester (luminous intensity: 200,000 Lux), and the density residual ratio (initial density: 2.0) after a 10 day exposure was obtained.

The results are shown in Table 20.

TABLE 20

| Sample No. | Coupler | Color image stabilizer | Stain | Yellow density residual ratio Initial density 2.0 Xe 200,000 Lux 10 days | Remarks |
|---|---|---|---|---|---|
| 1A | ExY | — | 0.15 | 67% | Comparative example |
| 2A | ↓ | Comparative compound 11 | 0.18 | 58% | ↓ |
| 3A | ↓ | Comparative compound 13 | 0.19 | 69% | ↓ |
| 4A | ↓ | I-A-1 | 0.11 | 88% | Present invention |
| 5A | ↓ | I-B-1 | 0.11 | 86% | ↓ |
| 6A | Y-10 | — | 0.17 | 50% | Comparative example |
| 7A | ↓ | I-A-2 | 0.11 | 81% | Present invention |
| 8A | ↓ | I-B-1 | 0.13 | 79% | ↓ |

From the results of Table 20, it is apparent that the samples of the present invention which contain the compounds of the present invention exhibit excellent effects in a multilayered light-sensitive material similar to the results of Example 1.

EXAMPLE 6

Sample 1B was prepared by following the procedure of Example 5 except that the cyan coupler in the fifth layer of sample 1A was replaced by an equimolar amount of the cyan coupler C-10 of the examples of the present invention.

Samples 2B to 18B were prepared by following the same procedure except that the cyan coupler and high boiling point organic solvent (Solv-3) in the fifth layer of sample 1B were replaced by the cyan couplers and the high boiling point organic solvents shown in Table 21, respectively. Further, samples 3B to 9B, 11B, 12B, 14B, 15B, 17B, and 18B, the additives listed in Table 21 were added in an equimolar amount of the high boiling point organic solvent. In sample 2B, twice the amount of the high boiling point organic solvent was used. Each sample was exposed to light and developed in the same manner as described for sample 1A of Example 5.

The absorption spectrum of the developed sample was measured with a spectrophotometer (Shimazu UM365). The magnitude of absorbance at 600 nm, under the condition that the absorbance at the wavelength of maximum absorbance was standardized to be 1, was expressed by $D_{600\,nm}$, and was taken as an indicator for the level of association. Smaller values of $D_{600\,nm}$ indicate lower levels of association. Moreover, the maximum color density ($D_{max}$) of each processed sample was measured using red color rays.

The data of $D_{600\,nm}$ and $D_{max}$ of each sample are shown in Table 21.

TABLE 21

| Sample No. | Coupler | High B.P. organic solvent | Additive | $D_{600\,nm}$ | $D_{max}$ | Remarks |
|---|---|---|---|---|---|---|
| 1B | C-10 | Solv-3 | — | 88.8 | 2.23 | Comparative example |
| 2B | ↓ | ↓(*) | — | 81.3 | 2.31 | ↓ |
| 3B | ↓ | ↓ | CS-1 | 72.3 | 1.92 | ↓ |
| 4B | ↓ | ↓ | CS-2 | 73.5 | 1.95 | ↓ |
| 5B | ↓ | ↓ | CS-3 | 72.7 | 1.87 | ↓ |
| 6B | ↓ | ↓ | CS-4 | 71.2 | 1.85 | ↓ |
| 7B | ↓ | ↓ | CS-5 | 72.3 | 1.99 | ↓ |
| 8B | ↓ | ↓ | I-B-13 | 67.8 | 2.33 | Present invention |
| 9B | ↓ | ↓ | I-C-17 | 72.4 | 2.36 | ↓ |
| 10B | ↓ | Solv-2 | — | 98.6 | 2.15 | Comparative example |
| 11B | ↓ | ↓ | I-B-13 | 77.3 | 2.33 | Present invention |
| 12B | ↓ | ↓ | I-C-17 | 79.7 | 2.34 | ↓ |
| 13B | C-12 | Solv-3 | — | 79.4 | 2.29 | Comparative example |
| 14B | ↓ | ↓ | I-B-13 | 66.2 | 2.31 | Present invention |
| 15B | ↓ | ↓ | I-C-17 | 71.4 | 2.33 | ↓ |
| 16B | C-13 | ↓ | — | 81.5 | 2.34 | Comparative example |
| 17B | ↓ | ↓ | I-B-13 | 68.4 | 2.36 | Present invention |
| 18B | ↓ | ↓ | I-C-17 | 72.4 | 2.36 | ↓ |

*: Twice the amount of Solv-3 is used only in sample 2B.

Comparative compound (CS-1)

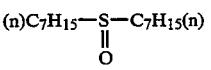

Comparative compound (CS-2)

-continued

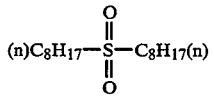

Comparative compound (CS-3)

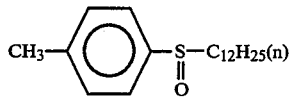

Comparative compound (CS-4)

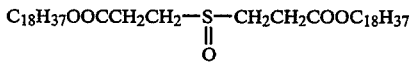

Comparative compound (CS-5)

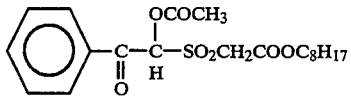

The results of Table 21 revealed the following:

When sample 1B and samples 3B–9B and the like are compared, it is apparent that the addition of sulfoxides or sulfones to Solv-3 makes the value of $D_{600\,nm}$ smaller, which means association is suppressed. Moreover, when samples 3B–7B and samples 8B, 9B are compared, it is understood that although the addition of sulfoxides or sulfones which are outside the scope of the present invention makes the $D_{max}$ value low, causing unsatisfactory color density, addition of sulfoxides or sulfones which are within the scope of the present invention makes the $D_{max}$ value higher than the value obtained when they are not added. This indicates that an excellent color generating property can be obtained by the present invention.

EXAMPLE 7

The same procedure as employed for preparing sample 101 of Example 1 described in JP-A-2-854 (hereinafter this publication is referred to as H2a) was used to prepare samples except that 25 mol % of each of the compounds (I-A-1), (I-A-6), (I-B-1), (I-B-4) or (I-C-5) of the present invention were coemulsified and added to the respective couplers of the third, fourth and fifth layers.

Further, other samples were prepared by using the same procedure employed for preparing sample 101 of H2a, except that 25 mol % of each of the compounds (I-A-1), (I-A-14), (I-B-4), (I-B-13) or (I-C-5) of the present invention were coemulsified and added to the respective couplers of the 12th and 13th layers.

These samples were exposed and developed in the same manner as employed for H2a. A discoloration test was conducted and photographic characteristics were investigated. As a result, it was found that the samples according to the present invention exhibited excellent anti-fading effects and had good photographic characteristics.

It is evident that the compounds of the present invention exhibit excellent effects in the above light-sensitive materials.

EXAMPLE 8

The same procedure employed for preparing color photographic light-sensitive materials described in Example 2 of JP-A-1-158431 (hereinafter this publication is referred to as H1) was followed to prepare samples except that equimolar amounts of each of the compounds (I-A-6), (I-A-19), (I-B-1) or (I-C-1) of the present invention were used in place of Cpd-9 in the sixth and seventh layers.

Further, other samples were prepared by using the same procedure as employed for preparing color photographic light-sensitive materials of H1, except that equimolar amounts of each of the compounds (I-A-1), (I-B-1), (I-B-4), (I-C-2) or (I-C-13) of the present invention were used in place of Cpd-6 in the 11th and 12th layers.

These samples were exposed and developed in the same manner as employed for H1. A discoloration test was conducted and photographic characteristics were investigated. As a result, it was found that the samples according to the present invention exhibited excellent anti-fading effects and had good photographic characteristics.

It is evident that the compounds of the present invention exhibit excellent effects in the above light-sensitive materials.

EXAMPLE 9

The same procedure employed for preparing sample 101 of Example 1 described in JP-A-2-93614 (hereinafter this publication is referred to as H2b) was used to prepare samples except that 25 mol % of each of the compounds (I-A-1), (I-A-6), (I-B-1), (I-B-4) or (I-C-5) of the present invention were coemulsified and added to the respective couplers of the 11th, 12th and 13th layers.

These samples were exposed and developed in the same manner as employed for H2b. A discoloration test was conducted and photographic characteristics were investigated. As a result, it was found that the samples according to the present invention exhibited excellent anti-fading effects and had good photographic characteristics.

It is evident that the compounds of the present invention exhibit excellent effects in the above light-sensitive materials.

According to the present invention, silver halide color photographic light-sensitive materials, which are excellent for color reproduction of color images formed by a color developing process, are provided such that light-fastness can be improved significantly compared with light fastness obtainable by known anti-fading agents, stains in unexposed portions can be reduced, and color balance in fading can be controlled.

We claim:

1. A silver halide color photographic light-sensitive material comprising a support having thereon at least one layer which contains at least one compound represented by the following formula (I):

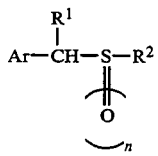

(I)

wherein $R^1$ represents an alkyl group, an aryl group or a heterocyclic group; $R^2$ represents an alkyl group having a substituent; Ar represents an aryl group; Ar and $R^1$ may be linked to form a 5- to 7-membered ring but $R^2$ and Ar, or $R^2$ and $R^1$ do not link with each other; and n represents an integer of 0 to 2.

2. The silver halide color photographic light-sensitive material as claimed in claim 1, wherein $R^1$ in formula (I) represents an alkyl group or an aryl group.

3. The silver halide color photographic light-sensitive material as claimed in claim 1, wherein $R^2$ in formula (I) represents a benzyl group which may have a substituent.

4. The silver halide color photographic light-sensitive material as claimed in claim 1, wherein the compound represented by formula (I) is a compound represented by formulae (I-A-a), (I-B-b) or (I-C-c):

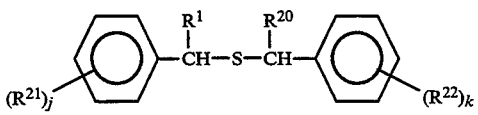
(I-A-a)

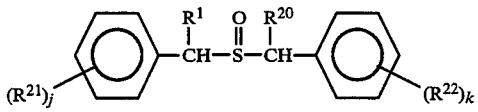
(I-B-b)

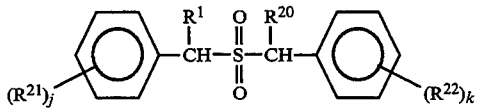
(I-C-c)

wherein $R^1$ has the same meaning as $R^1$ in formula (I); $R^{20}$ represents a hydrogen atom, an alkyl group, an aryl group or a heterocyclic group; $R^{21}$ and $R^{22}$ each independently represents a substituent which may be the same or different from each other; $R^1$ and $R^{21}$, or $R^{20}$ and $R^{22}$ may be linked to form a 5- to 7-membered ring, provided that $R^1$ and $R^{20}$ or $R^{22}$, and $R^{20}$ and $R^{21}$ cannot be linked; j and k each independently represents an integer of 0 to 5, and when both j and k are respectively not less than 2, respective $R^{21}$ of a plurality of $R^{21}$ may be the same or different and respective $R^{22}$ of a plurality of $R^{22}$ may be the same or different; among the plurality of $R^{21}$, any two $R^{21}$ in an ortho-relation may be linked to form a 5- to 7-membered ring; and among the plurality of $R^{22}$, $R^{22}$ in the ortho-relation may be linked to form a 5- to 7-membered ring.

5. The silver halide color photographic light-sensitive material as claimed in claim 4, wherein $R^{21}$ and $R^{22}$ each independently represents an alkyl group, an alkenyl group, an alkynyl group, an aryl group, a heterocyclic group, a halogen atom, a cyano group, a nitro group, a hydroxyl group, an alkoxy group, an aryloxy group, an alkylthio group, an arylthio group, an acyloxy group, a sulfonyloxy group, an amino group, an alkylamino group, an arylamino group, an acylamino group, a sulfonamide group, an alkoxycarbonylamino group, an alkoxysulfonylamino group, a ureido group, an acyl group, an alkoxycarbonyl group, a carbamoyl group, a sulfonyl group, a sulfinyl group, an alkoxysulfonyl group or a sulfamoyl group.

6. The silver halide color photographic light-sensitive material as claimed in claim 4, wherein $R^{21}$ and $R^{22}$ each independently represents an alkyl group, an aryl group, a heterocyclic group, an alkoxy group, an aryloxy group, an alkylthio group, an arylthio group, an alkoxycarbonyl group, a carbamoyl group, an acyl group or a halogen atom.

7. The silver halide color photographic light-sensitive material as claimed in claim 4, wherein $R^{21}$ and $R^{22}$ each independently represents an alkyl group, an aryl group, an alkoxy group, an aryloxy group, an alkylthio group, an arylthio group or a halogen atom.

8. The silver halide color photographic light-sensitive material as claimed in claim 4, wherein j and k are respectively 1 or 2.

9. The silver halide color photographic light-sensitive material as claimed in claim 1, wherein the layer which contains at least one compound represented by formula (I) is a yellow coupler-containing layer.

10. The silver halide color photographic light-sensitive material as claimed in claim 9, wherein the yellow coupler-containing layer comprises at least one yellow coupler represented by formula (Y):

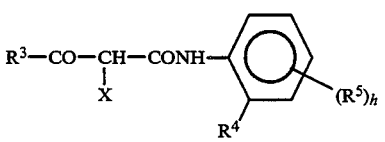
(Y)

wherein $R^3$ represents a tert-alkyl group, an aryl group or $—N(R^6)(R^7)$; $R^4$ represent a hydrogen atom, a halogen atom, an alkoxy group, an aryloxy group, an alkyl group or a dialkylamino group; $R^5$ represents a substituent; X represents a hydrogen atom or a releasable group in a coupling reaction with an oxidation product of an aromatic primary amine color developing agent; h represents an integer of 0 to 4; when h is not less than 2, each $R^5$ may be the same or different; $R^6$ and $R^7$ may be the same or different from each other and each independently represents an alkyl group, an alkenyl group, an aryl group or a heterocyclic group; $R^6$ and $R^7$ may be linked to form a 5- to 6-membered ring which may optionally have a substituent and may form a condensed ring with an aromatic ring, aliphatic ring or a heterocyclic ring.

11. The silver halide color photographic light-sensitive material as claimed in claim 10, wherein $R^5$ represents a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, a sulfonyl group, a sulfonylsulfamoyl group, a sulfonylcarbamoyl group, a ureido group, an acylcarbamoylamino group, an acylsulfamoylamino group, a sulfamoylamino group, an alkoxycarbonylamino group, an acylsulfamoyl group, an acylcarbamoyl group, a nitro group, a heterocyclic group, a cyano group, an acyl group, an acyloxy group, an alkylsulfonyloxy group or an arylsulfonyloxy group; and the releasable group which is X in formula Y represents a heterocyclic group which is bound to the coupling active site with a nitrogen atom, an aryloxy group, an arylthio group, an acyloxy group, an alkylsulfonyloxy group, a heterocyclicoxy group or a halogen atom.

12. The silver halide color photographic light-sensitive material as claimed in claim 1, wherein a compound represented by formula (I) is contained in an amount of $2\times10^{-4}$ to 20 g per 1 $m^2$ of said light-sensitive material.

13. The silver halide color photographic light-sensitive material as claimed in claim 1, wherein substituents of $R^2$ are selected from the group consisting of an alkyl group, an alkenyl group, and alkynyl group, and aryl group, a heterocyclic group, a halogen atom, a cyano group, a nitro group, a hydroxyl group, an alkoxy group, an aryloxy group, an alkylthio group, an arylthio group, an acyloxy group, a sulfonyloxy group, an amino group, an alkylamino group, an arylamino group, an acylamino group, a sulfonamide group, an alkoxycarbonylamino group, an alkoxysulfonylamino group, a ureido group, an acyl group, an alkoxycarbonyl group, a carbamoyl group, a sulfonyl group, a sulfinyl group, an alkoxysulfonyl group, and a sulfamoyl group.

* * * * *